US006075485A

United States Patent [19]

Lilly et al.

[11] Patent Number: 6,075,485

[45] Date of Patent: Jun. 13, 2000

[54] REDUCED WEIGHT ARTIFICIAL DIELECTRIC ANTENNAS AND METHOD FOR PROVIDING THE SAME

[75] Inventors: James D. Lilly; David T. Auckland, both of Silver Spring; William E. McKinzie, III, Fulton, all of Md.

[73] Assignee: Atlantic Aerospace Electronics Corp., Greenbelt, Md.

[21] Appl. No.: 09/185,205

[22] Filed: Nov. 3, 1998

[51] Int. Cl.[7] ..... H01Q 1/36

[52] U.S. Cl. ..... 343/700 MS; 343/895

[58] Field of Search ..... 343/700 MS, 911 R, 343/909, 910

[56] References Cited

U.S. PATENT DOCUMENTS

| | | | |
|---|---|---|---|
| 3,886,558 | 5/1975 | Cary et al. | 343/708 |
| 3,886,561 | 5/1975 | Beyer . | |
| 5,166,693 | 11/1992 | Nishikawa et al. | 342/422 |
| 5,325,103 | 6/1994 | Schuss | 343/700 MS |
| 5,385,623 | 1/1995 | Diaz | 156/197 |
| 5,400,043 | 3/1995 | Arceneaux et al. | 343/872 |
| 5,408,241 | 8/1995 | Shattuck, Jr. et al. | 342/700 MS |
| 5,662,982 | 9/1997 | Diaz | 428/116 |
| 5,712,605 | 1/1998 | Flory et al. | 333/219.1 |
| 5,714,961 | 2/1998 | Kot et al. | 343/769 |
| 5,739,796 | 4/1998 | Jasper, Jr. et al. | 343/895 |

*Primary Examiner*—Don Wong
*Assistant Examiner*—James Clinger
*Attorney, Agent, or Firm*—Pillsbury Madison & Sutro LLP

[57] ABSTRACT

An artificial anisotropic dielectric material is used as a microstrip patch antenna substrate and can achieve dramatic antenna weight reduction. The artificial dielectric is comprised of a periodic structure of low and high permittivity layers. The net effective dielectric constant in the plane parallel to the layers is engineered to be any desired value between the permittivities of the constituent layers. These layers are oriented vertically below the patch to support electric fields consistent with desired resonant modes. Substrates may be engineered for both linearly and circularly polarized patch antennas. Substrate weights can be reduced by factors of from 6 to 30 times using different types of high permittivity layers. This concept has numerous applications in electrically small and lightweight antenna elements, as well as in resonators, microwave lenses, and other electromagnetic devices.

43 Claims, 15 Drawing Sheets

REDUCED WEIGHT ARTIFICIAL DIELECTRIC ANTENNAS AND METHOD FOR PROVIDING THE SAME

BACKGROUND OF THE INVENTION

1. Field of the Invention

The present invention relates to antennas and dielectric substrate materials therefor, and in particular, to microstrip antenna dielectric materials that are capable of use in portable or mobile applications where minimal aperture size and weight are desired.

2. Description of the Related Art

A top view of a conventional probe-fed microstrip patch antenna 10 is illustrated in FIG. 1. A cross-sectional view of antenna 10 taken along line 2—2 in FIG. 1 is illustrated in FIG. 2. As shown, antenna 10 consists of a radiating element being a rectangular conductive patch 12 printed on the upper surface of a dielectric substrate 14 having uniform height H and having a relative permittivity tensor $\epsilon$. The lower surface 16 of the substrate is also metalized, and a coaxial connector 18 attaches the shielded outer conductor of coaxial cable 24 thereto. The center conductor 20 of coaxial cable 24 serves as a feed probe and protrudes up through the substrate so as to electrically connect to the patch 12 at feed 22.

Dielectric substrate 14 of conventional microstrip patch antenna 10 is an homogeneous substrate. Typically, the dielectric materials forming substrate 14 are isotropic, where there exists no preferred dielectric polarization direction (i.e. $\epsilon_x=\epsilon_y=\epsilon_z$). In some cases though, the homogeneous substrate is an anisotropic dielectric with a uniaxial relative permittivity tensor given by $$\bar{\bar{\varepsilon}} = \begin{pmatrix} \varepsilon_x & 0 & 0 \\ 0 & \varepsilon_y & 0 \\ 0 & 0 & \varepsilon_z \end{pmatrix} \tag{1}$$

Where $\epsilon_x=\epsilon_y\neq\epsilon_z$ and the z axis (the uniaxial axis, i.e. the axis of anisotropy) is normal to the plane of the patch.

As dielectric materials, many woven materials such as fiberglass exhibit such uniaxial behavior as a result of their manufacturing techniques. However, this type of anisotropy is usually slight. Since the material's uniaxial axis (z axis) is normal to the patch surface, the anisotropy is tolerated but not desired as it complicates the antenna design process without yielding any corresponding benefit.

Another consideration in the selection of dielectric materials is weight. For example, the weight of a microstrip patch antenna operating at low frequencies (below 1 GHz) can be excessive due to the large physical dimensions of the substrate and/or the high specific gravity of the material comprising the substrate. For mobile applications involving autos, aircraft, and spacecraft, antenna weight can be a serious engineering constraint, even for higher frequency antennas.

The length L of a patch antenna printed on a low permittivity substrate (foam, for example has a relative permittivity $\epsilon_r$ of about 1.1) is approximately $\lambda/2$, where $\lambda$ is the free space wavelength. For a given resonant frequency, the patch dimensions may be reduced by the approximate scale factor of $1/\mathrm{sqrt}(\epsilon_r)$ by using a higher permittivity substrate, where $\epsilon_r$ is the relative permittivity of the isotropic substrate. At low frequencies, reducing the size of the patch antenna by appropriate selection of higher permittivity substrates is even more desired because $\lambda$ becomes large. For example, $\lambda$=1 meter at 300 MHz. However, even though such high permittivity substrates can reduce the patch dimensions, the overall weight of the antenna can be increased. This is because high permittivity, high quality substrate materials such as RT/duroid (a trademark of Rogers Corp. of Rogers, Conn.), for example, have a specific gravity of from 2.1 to 2.9 grams/cm$^3$. Microwave quality ceramic materials can be even heavier with a typical specific gravity of from 3.2 to 4 grams/cm$^3$.

One solution is to make the substrates thinner (i.e., making the height H smaller) to reduce their overall volume and, hence, their weight. This can be done while maintaining the antenna's resonant frequency. However, the 2:1 VSWR bandwidth (and the 1 or 3 dB gain bandwidth) will decrease almost linearly in proportion to the height reduction of the substrate. Microstrip antennas are inherently narrow band even without reducing this height. For example, an element such as that shown in FIG. 1 with a 10% substrate height to patch length ratio (i.e., H/L=0.10) has a 2:1 VSWR bandwidth of only 1.8% ($\epsilon_r$=6) to 3.5% ($\epsilon_r$=1). So this approach to weight reduction can only be used for very narrow bandwidth applications, and is unsuitable for broadband applications.

Schuss (U.S. Pat. No. 5,325,103) proposed the use of a high dielectric syntactic foam as a lightweight substrate material under a patch antenna. He does not specify the value or range of permittivities used. However, experience has shown that such high permittivity foam materials usually have high loss tangents, and high loss tangents are responsible for significant gain degradation in electrically small elements. In contrast, low loss tangent dielectrics (tan $\delta$<0.002) are required to build a patch antenna with high radiation efficiency in excess of 90%, especially if the antenna is electrically small (patch length L<$\lambda/4$).

What is needed in the art, therefore, is a new technique to achieve a significant weight reduction in dielectric substrate materials suitable for patch antenna applications without compromising the bandwidth or radiation efficiency characteristics of such antennas. The present invention fulfills this need.

SUMMARY OF THE INVENTION

An object of the invention is to provide a lightweight patch antenna.

Another object of the invention is to reduce the weight of a patch antenna without reducing the bandwidth of the antenna.

Another object of the invention is to reduce the weight of a patch antenna without reducing the radiation efficiency of the antenna.

Another object of the invention is to reduce the weight of dielectric substrate materials suitable for antenna applications.

Another object of the invention is to provide artificial dielectric substrate materials suitable for antenna applications that have low loss tangents.

Another object of the invention is to provide a method of reducing the weight of a patch antenna.

Another object of the invention is to provide a method of engineering the relative permittivity of an artificial dielectric substrate.

Another object of the invention is to provide a method of providing a reduced weight antenna substrate whose permittivity can be easily designed to any desired value.

These objects and others are achieved by the present invention, wherein an artificial anisotropic dielectric material is used as a microstrip patch antenna substrate. The artificial dielectric can be easily designed for the purpose of weight reduction. Preferably, the artificial dielectric is comprised of a periodic stack of low and high permittivity layers. The net effective dielectric constant in the plane parallel to the layers can be engineered to any desired value between the permittivities of the constituent layers. The layers can be oriented vertically below the patch to support electric fields consistent with desired resonant modes. Substrates may be engineered for both linearly and circularly polarized patch antennas. Antenna weight can be reduced to ⅙th up to 1/30th of the original weight using different types of high permittivity layers. This concept has numerous applications in electrically small and lightweight antenna elements, as well as in resonators, and RF and microwave lenses.

BRIEF DESCRIPTION OF THE DRAWINGS

These and other objects and advantages of the present invention will become apparent to those skilled in the art after considering the following detailed specification, together with the accompanying drawings wherein.

DETAILED DESCRIPTION OF THE PREFERRED EMBODIMENTS

Figure 1:
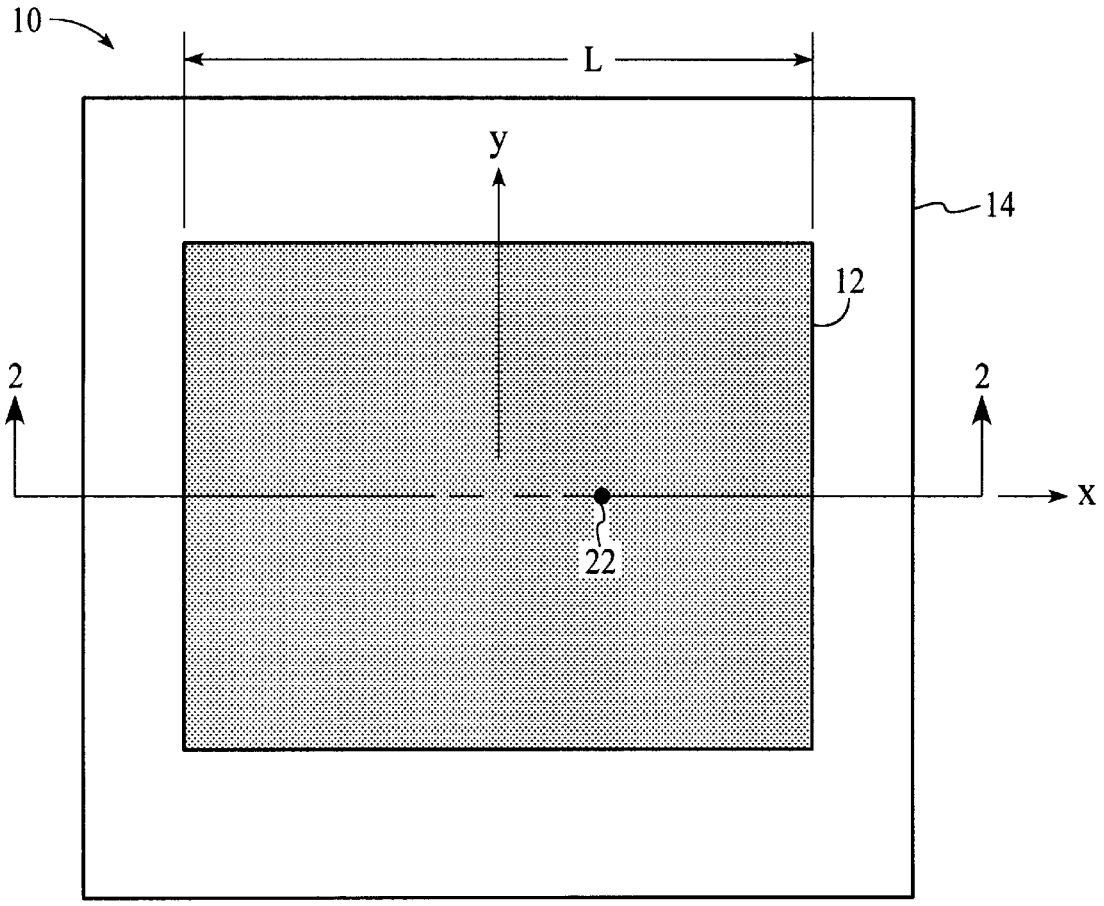
FIG. 1 (PRIOR ART)
FIG. 1 is a top view of a conventional microstrip patch antenna.
Figure 2:
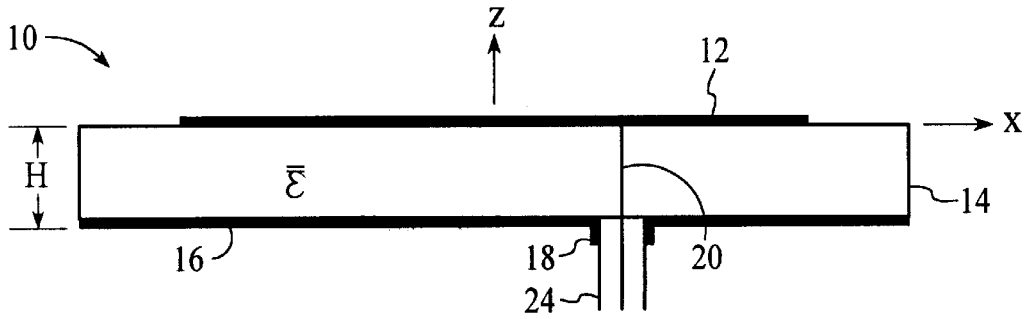
FIG. 2 (PRIOR ART)
FIG. 2 is a side view of the conventional antenna taken along cross-sectional line 2—2 in FIG. 1.
Figure 3:
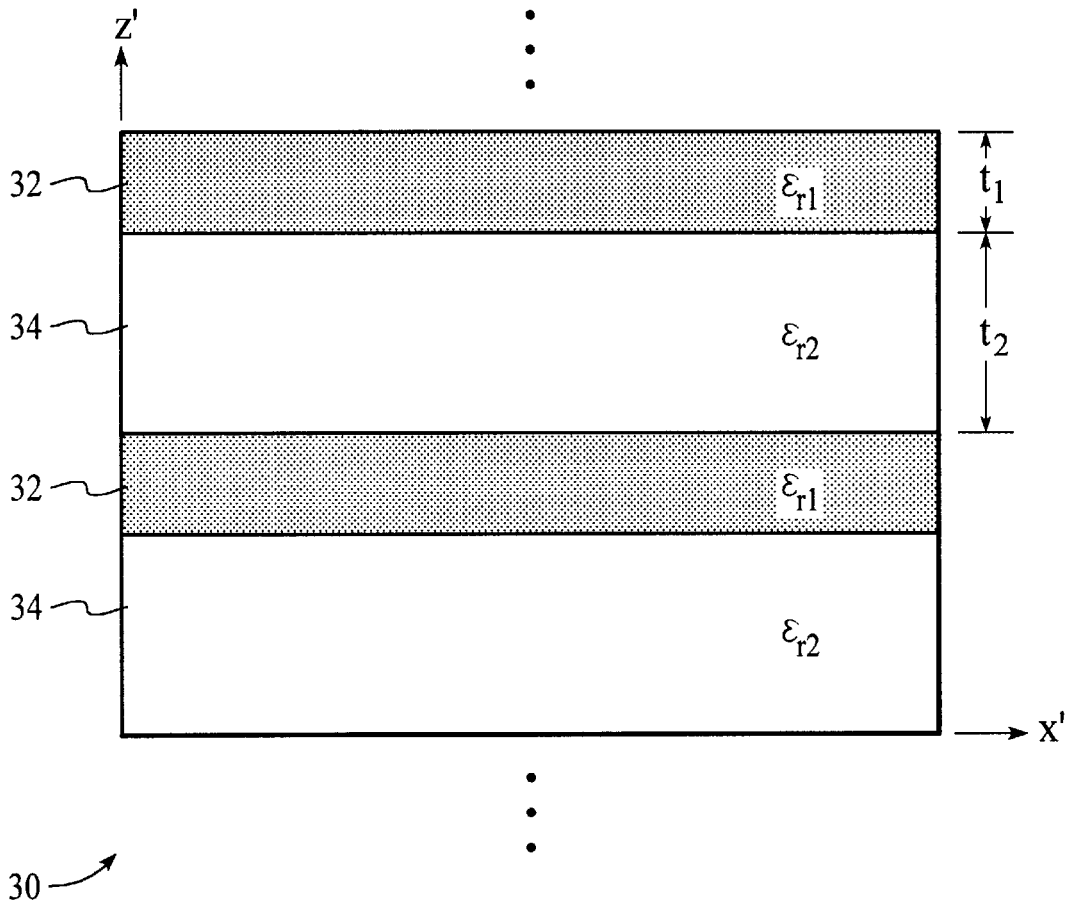
FIG. 3 illustrates a layered artificial dielectric material constructed in accordance with the principles of the present invention.

An artificial dielectric structure 30 according to the present invention is shown in FIG. 3. It comprises a periodic structure or stack of alternating layers of high and low permittivity isotropic dielectric materials 32 and 34, having respective relative permittivities of $\epsilon_{r1}$ and $\epsilon_{r2}$. As shown in the drawing, layers 32 and 34 have respective thicknesses of $t_1$, and $t_2$, and the direction normal to the surface of the layers is parallel with the z axis. The number of alternating layers 32 and 34 used in the stack depends on their respective thicknesses and the overall size of the structure desired.

Although the individual layers 32 and 34 are preferably isotropic with relative permittivities of $\epsilon_{r1}$ and $\epsilon_{r2}$ respectively, as constructed together in the periodic structure of FIG. 3, the composite structure 30 is an anisotropic dielectric. Its permittivity tensor is given by equation (2), where the z' axis is normal to the stack surface (i.e., parallel to the direction in which the layers are stacked) as shown in FIG. 3. The principal axes of the artificial dielectric are denoted with primed coordinates x', y' and z'.

$$\bar{\bar{\varepsilon}} = \begin{pmatrix} \varepsilon_{x'} & 0 & 0 \\ 0 & \varepsilon_{y'} & 0 \\ 0 & 0 & \varepsilon_{z'} \end{pmatrix} \tag{2}$$

Diagonal elements are approximated at low frequencies by $$\varepsilon_{x'} = \varepsilon_{y'} = \frac{\varepsilon_{r1}t_1 + \varepsilon_{r2}t_2}{t_1 + t_2} = \frac{\varepsilon_{r1} + \varepsilon_{r2}(t_2/t_1)}{1 + (t_2/t_1)}, \tag{3}$$

$$\varepsilon_{z'} = \frac{(t_1 + t_2)}{(t_1/\varepsilon_{r1}) + (t_2/\varepsilon_{r2})}, \tag{4}$$

$$\text{and } \varepsilon_{x'} = \varepsilon_{y'} > \varepsilon_{z'} \tag{5}$$

Figure 4:
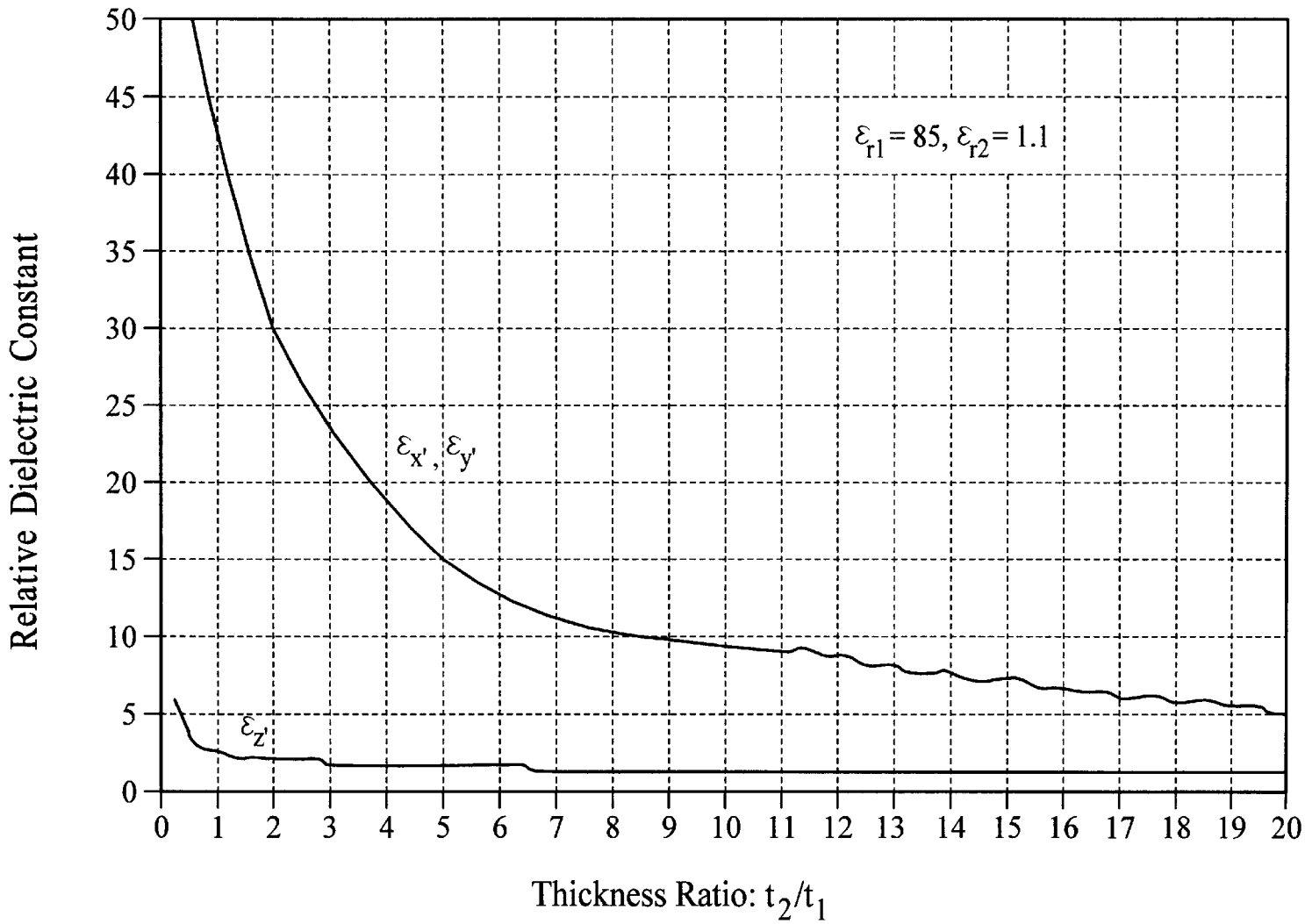
FIG. 4 is a graph illustrating the permittivities achieved vs. thicknesses of layers in one example of an artificial dielectric material such as that illustrated in FIG. 3.

Low frequencies are those frequencies f ($\omega=2\pi f$) for which the electrical thickness $\beta_n t_n << 1$, where $\beta_n = \omega \times \text{sqrt}(\mu_0\epsilon_0\epsilon_m)$ for n=1,2. According to an aspect of the invention, the physical thickness $t_n$ of each layer is thus an engineering parameter which may be varied subject to the condition that $t_n << 1/\beta_n$. One of the merits of the structure of FIG. 3 is that tensor permittivities $\epsilon_{x'}$ and $\epsilon_{y'}$ can be engineered to be any value between $\epsilon_{r1}$ and $\epsilon_{r2}$ by appropriate selection of the respective thicknesses for given respective permittivities of layers 32 and 34. FIG. 4 is a graph showing an example of the invention where relative permittivity values of 45 down to 5 are obtained for thickness ratios ($t_2/t_1$) of from 1 to 20.

It should be noted that $\epsilon_{x'}$ and $\epsilon_{y'}$ are not necessarily equal. They can, in fact, be designed to be unequal while still yielding an anisotropic artificial dielectric structure. Generally, however, in the specific applications that will be described in more detail herein, both $\epsilon_x$ and $\epsilon_y$ will be greater than $\epsilon_z$ by factors of from 5 to 10.

The weight of the resulting structure 30 can be easily designed as well. Particularly, if the specific gravity of layers 32 and 34 are denoted as $sg_1$ and $sg_2$ respectively, then the effective specific gravity of the composite dielectric, $sg_{eff}$, (assuming all other dimensions of layers 32 and 34 are the same) is $$sg_{eff} = \frac{sg_1 t_1 + sg_2 t_2}{t_1 + t_2} \tag{5}$$

Accordingly, a significant weight savings can be achieved by selecting a thin high permittivity dielectric material for layer 32 and a much thicker but very low weight dielectric material such as foam for layer 34.

As an example, consider that an homogeneous microwave quality ceramic substrate (for example, alumina, $\epsilon_r \approx 10$) typically has a specific gravity of about 3.2 grams/cm$^3$. To replace it with an artificial dielectric material of similar permittivity according to the present invention, layer 32 can be chosen to be a higher permittivity ceramic with $\epsilon_{r1} \approx 85$ and $sg_1 \approx 3.2$ grams/cm$^3$, and layer 34 a foam spacer such as Rohacell foam ($\epsilon_{r2} \approx 1.1$ and $sg_2 = 0.1$). As shown in the chart in FIG. 4, this yields an effective permittivity $\epsilon_{x'}$ and $\epsilon_{y'}$ of about 10 for a thickness ratio of $t_2/t_1 = 8.4$. Meanwhile, for this same thickness ratio, the effective specific gravity $sg_{eff}$ from equation (5) is only 0.43. Accordingly, a substrate comprised of an artificial dielectric structure according to the invention and having the same overall dimensions will weigh only about 14% as much as the homogenous substrate.

Even greater weight savings can be achieved when the high permittivity dielectric material layer 32 is itself an artificial dielectric material, such as a frequency selective surface (FSS). Such materials have traditionally been used to filter plane waves in applications such as antenna radomes or dichroic (dual-band) reflector antennas. However, in this new application, a capacitive FSS is used as a subsystem component in the design of a larger artificial dielectric material: i.e., the periodic structure 30. For example, a 0.020" thick FSS can be designed to represent an equivalent permittivity of up to $\epsilon_r = 800$, while exhibiting a specific gravity of only about ~2.5 grams/cm$^3$, further improving the results obtained in the above example.

Figure 5:
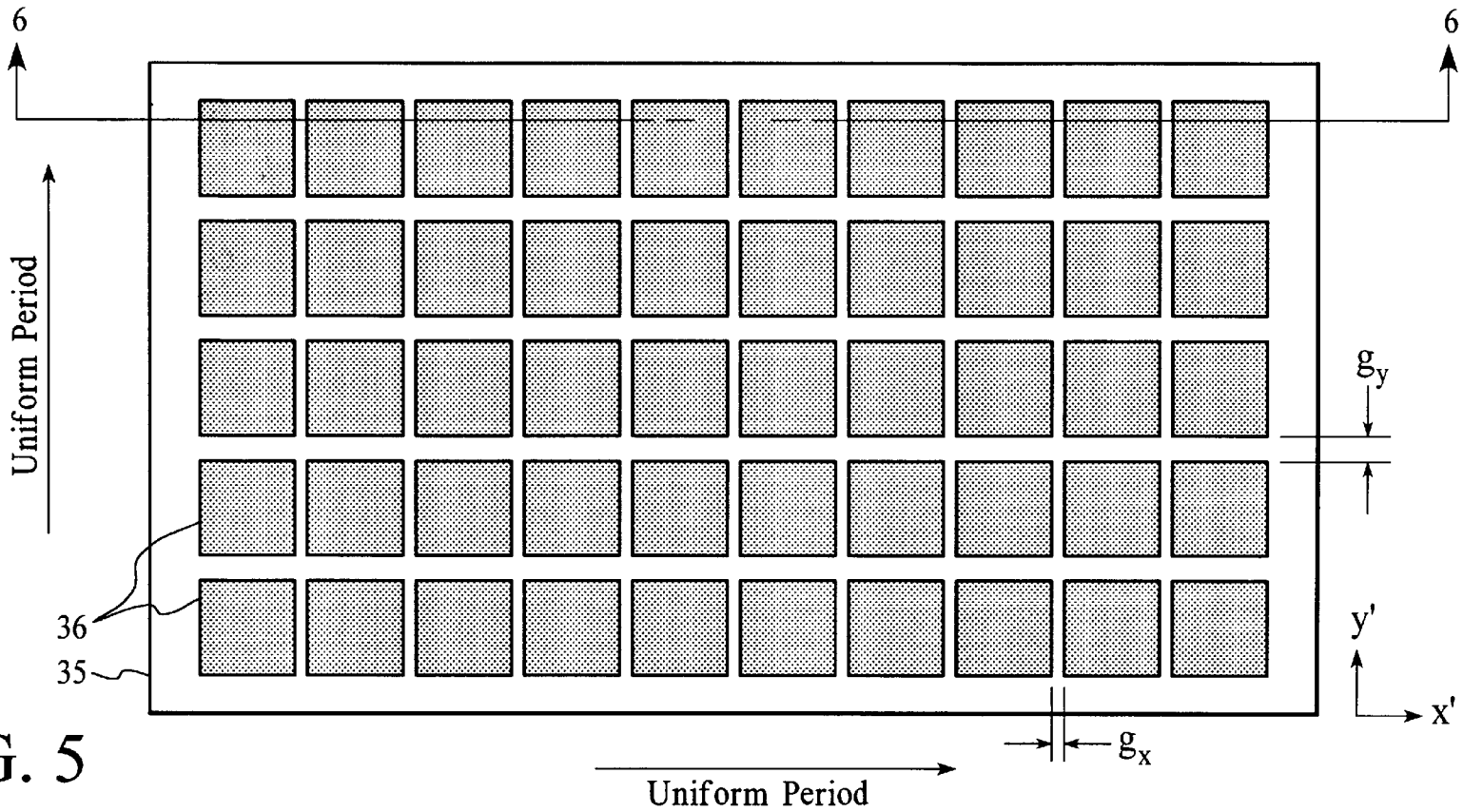
FIG. 5 is a top view of one example of a frequency selective surface for use in a layered artificial dielectric material in accordance with the principles of the invention.
Figure 6:
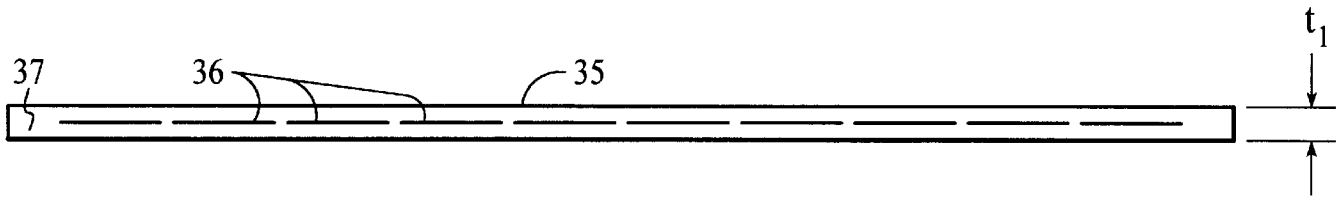
FIG. 6 is a side view of the FSS in FIG. 5 taken along sectional line 6—6.

As shown in FIGS. 5 and 6, a frequency selective surface (FSS) 35 for possible use as a high permittivity dielectric material 32 in structure 30 is an electrically thin layer of engineered material (typically planar in shape) which is typically comprised of periodic metallic patches or traces 36 laminated within a dielectric material 37 for environmental protection.

The electromagnetic interaction of an FSS with plane waves may be understood using circuit analog models in which lumped circuit elements are placed in series or parallel arrangements on an infinite transmission line which models the plane wave propagation. FSS structures are said to be capacitive when their circuit analog is a single shunt capacitance. This shunt capacitance, C (or equivalent sheet capacitance), is measured in units of Farads per square area. Equivalently, the reactance presented by the capacitive FSS can be expressed in units of ohms per square area. This shunt capacitance is a valid model at low frequencies where $(\beta_1 t \beta_1) << 1$, and $t_1$ is the FSS thickness. As a shunt capacitance, electromagnetic energy is stored by the electric fields between metal patches. Physical implementations of capacitive FSS structures usually contain periodic lattices of isolated metallic "islands" such as traces 36 upon which bound charges become separated with the application of an applied or incident electric field (an incident plane wave). The periods of this lattice are much less than a free space wavelength at frequencies where the capacitive model is valid. The equivalent relative dielectric constant of a capacitive FSS is given as $\epsilon_r = C/(\epsilon_0 t_1)$ where $\epsilon_0$ is the permittivity of free space. FSS structures can be made with $\epsilon_r$ values extending up to several hundred.

An important point to note is that $\epsilon_r$ may be made polarization sensitive by design. That is, in practical terms, the lattice spacing or island shape, or both, may be different for the x' and y' directions where these axes are the principal axes of the lattice. This yields equivalent sheet capacitance values which are polarization dependent. Thus $\epsilon_{rx}$ for x' polarized applied electric fields may be different from $\epsilon_{ry}$ for y' polarized E fields which is the case for an anisotropic FSS.

FIG. 5 is a top view of an anisotropic FSS 35 comprised of square metal patches 36 where each patch is identical in size, and buried inside a dielectric layer 37 (such as FR-4). FIG. 6 is a cross-sectional side view of FIG. 5 taken along sectional line 6—6 of FIG. 5. As shown, the gaps between patches 36 are denoted as $g_x$ in the x' direction and $g_y$ in the y' direction. If these variables are different dimensions, as shown in this figure, then the equivalent capacitance provided by the FSS is different for electric fields polarized in the x' and y' directions. Since $g_x$ is smaller than $g_y$, the equivalent sheet capacitance for x'-polarized E fields will be larger than for y'-polarized E fields. For a given value of incident E field, more energy will be stored for the x' polarized waves than for the y' polarized waves. This leads to $\epsilon_{rx} > \epsilon_{ry}$ in the FSS, and $\epsilon_{x'} > \epsilon_{y'}$ in the equivalent bulk permittivity for a layered substrate when it is included in a non-homogeneous stacked dielectric substrate according to the invention such as substrate 30 (assuming that the second layer is isotropic, such as foam).

It should be apparent that there are FSS design parameters, other than the gap width, which may yield unequal $\epsilon_{rx}$ and $\epsilon_{ry}$. For instance, the patches may be rectangular in shape.

Figure 7:
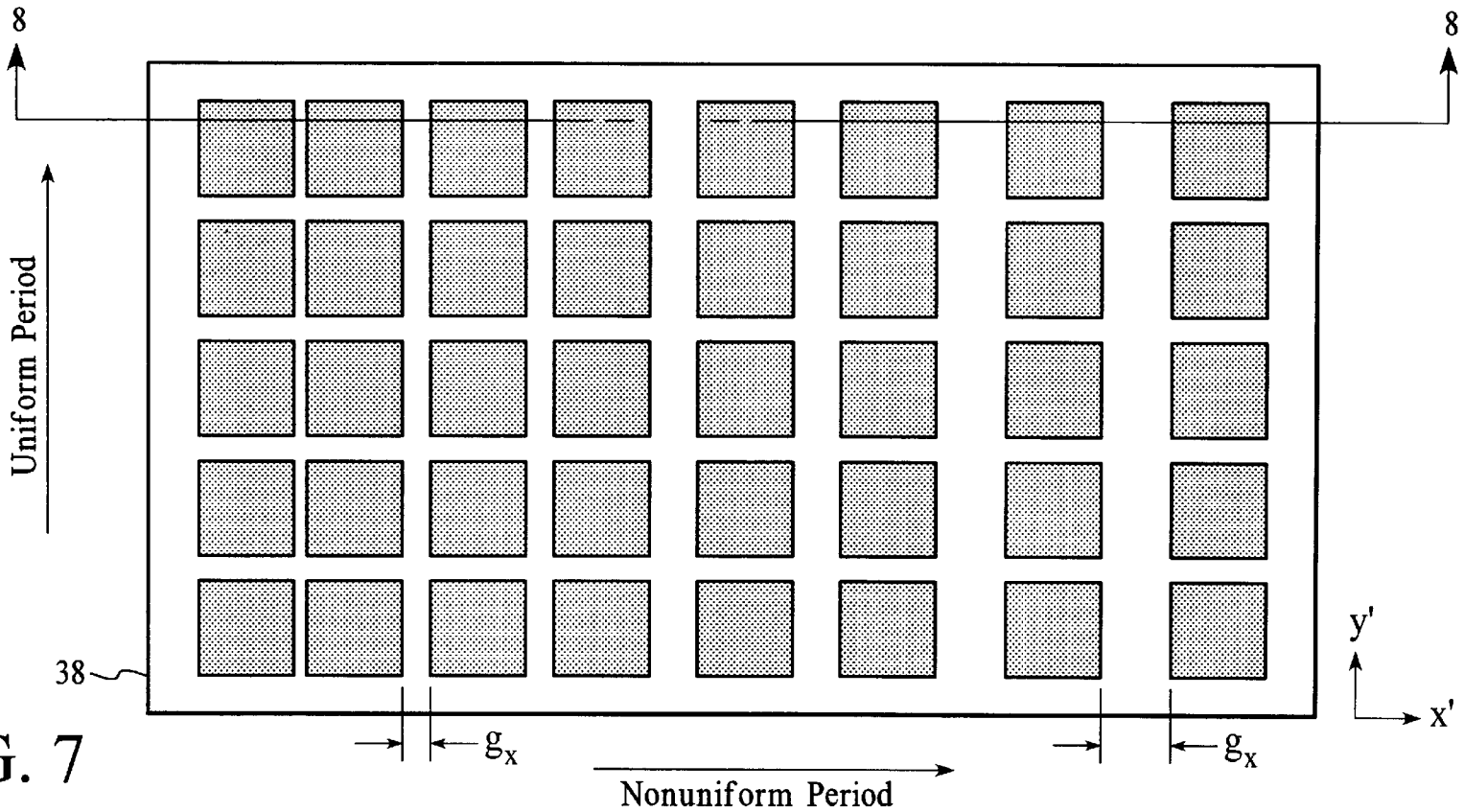
FIG. 7 is a top view of another example of a frequency selective surface for use in a layered artificial dielectric material in accordance with the principles of the invention.
Figure 8:
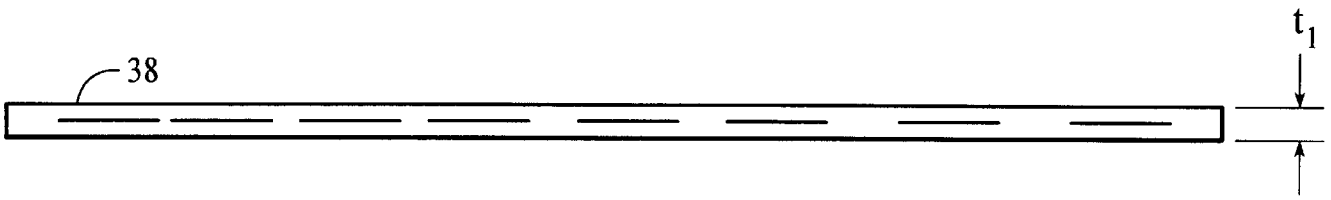
FIG. 8 is a side view of the FSS in FIG. 7 taken along sectional line 8—8.

FIGS. 7 and 8 illustrate variations on this theme where the equivalent sheet capacitance is intended to be relatively constant or uniform with position for y'-polarized E fields, but is engineered to vary with position in the x' direction since the gap size $g_x$ varies with position in the x' direction. So not only are $\epsilon_{rx}$ and $\epsilon_{ry}$ unequal, but the degree of inequality is a function of position within the FSS 38. This difference in tensor permittivity could be gently graded or modified in discrete steps. In the extreme case, both $\epsilon_{rx}$ and $\epsilon_{ry}$ could be made to vary with position on the FSS. Furthermore, the lattice principal axes don't have to be orthogonal, they could be skewed at an arbitrary angle other than 90°. It should be apparent that there are almost countless variations.

The FSS designs shown above are not meant to be limiting. Rather, it should be apparent that many different FSS designs can yield a broad range of equivalent sheet capacitances with equal or unequal polarization. For further information regarding such materials, see generally T. K.

Wu, "Frequency Selective Surface and Grid Array" (1995); C. K. Lee and R. J. Langley, "Design of a Single Layer Frequency Selective Surface," Int. J. Electronics, Vol. 63, pp. 291–296, March 1987.

An artificial dielectric structure 30 such as that illustrated in FIG. 3 can be fabricated in several different ways. For example, the foam spacer layers 34 can be sprayed with an aerosol adhesive such as Repositionable 75 Spray Adhesive made by 3M, and the ceramic or FSS layers 32 bonded thereto. When the desired number of layers are stacked together, force can be applied via a simple press or jig to compress the stack of layers. In another example, the high permittivity layers 32 are suspended in a fixture with the correct separation and orientation. Next, a foam such as a syntactic foam is injected between the layers to fill the voids. When the foam cures, thereby forming the low permittivity layers 34, a rigid block of artificial dielectric material is produced. As a further example, the artificial dielectric material is built entirely from printed FSS sheets that are soldered together like a card cage. The top, bottom, and sides of the structure are comprised of printed circuit cards that have periodic arrays of plated-through slots to accept and locate the tabs on the FSS sheets serving as high permittivity layers 32. Air gaps or spaces between the FSS sheets create the low permittivity layers 34. A standard soldering process such as wave soldering or vapor-phase reflow could be used for cost-effective assembly. Further, if the bottom and side cards are metalized over their full surface, they could also serve as an antenna cavity.

It should be noted that the artificial dielectric structure illustrated in FIG. 3 is vastly different from conventional artificial dielectric materials, which typically have metallic islands or inclusions suspended in a lightweight dielectric binder. Descriptions of materials having inclusions of spheres, ellipsoids, strips, conductive fibers, and other shapes have been published. See, for example, L. Lewin, "The Electrical Constants of Spherical Conducting Particles in a Dielectric," Jour. IEEE (London), Vol. 94, Part III, pp. 65–68, January 1947; R. W. Corkum, "Isotropic Artificial Dielectrics," Proc. IRE, Vol. 40, pp. 574–587, May 1952; M. M. Z. Kharadly et al., "The Properties of Artificial Dielectrics Comprising Arrays of Conducting Elements," Proc. IEE (London), Vol. 100, Part III, pp. 199–212, July 1953; S. B. Cohn, "Artificial Dielectrics for Microwaves," in Modern Advances in Microwave Techniques, Polytech. Inst. Brooklyn Symposium Proc., Vol. 4, pp. 465–480, November 1954; R. E. Collin, "Artificial Dielectrics," in Field Theory of Guided Waves, Ch. 12, pp. 509–551 (1960); Leonard S. Taylor, "Dielectric Properties of Mixtures," IEEE Transactions on Antennas and Propagation, Vol. AP-13, No. 6, pp. 943–947, November 1965.

It should be further noted that although the structure in FIG. 3 is akin to structures in optics known as multilayer films or 1D Bragg gratings (i.e., Bragg stacks), there are many important differences. Such Bragg structures are used in optical mirrors and filters, wherein at optical frequencies the typical electrical thickness of each layer is at least 0.5 radian, and the typical physical thickness of each layer is 100 to 1000 micrometers (0.004 to 0.040 in.). Moreover, in such applications, wave propagation is in the z' direction of FIG. 3, normal to the layer surface.

In contrast, the artificial dielectric structure of the present invention is proposed for applications with much lower frequencies, typically less than 1 GHz. Furthermore, although the individual dielectric layers are physically much thicker (0.040 in.$<t_1,t_2<$0.5 in.), the operating frequencies are so much lower that each layer is electrically very thin (0.04 to 0.08 radians near 300 MHz, i.e., $\beta_n t_n \ll 1$). Also, in further contrast to optical applications, in antenna applications that will be described in more detail below, the wave propagation direction for standing waves under the patch is parallel to the layered surface, not perpendicular (i.e., in the x' or y' directions of FIG. 3).

Figure 9:
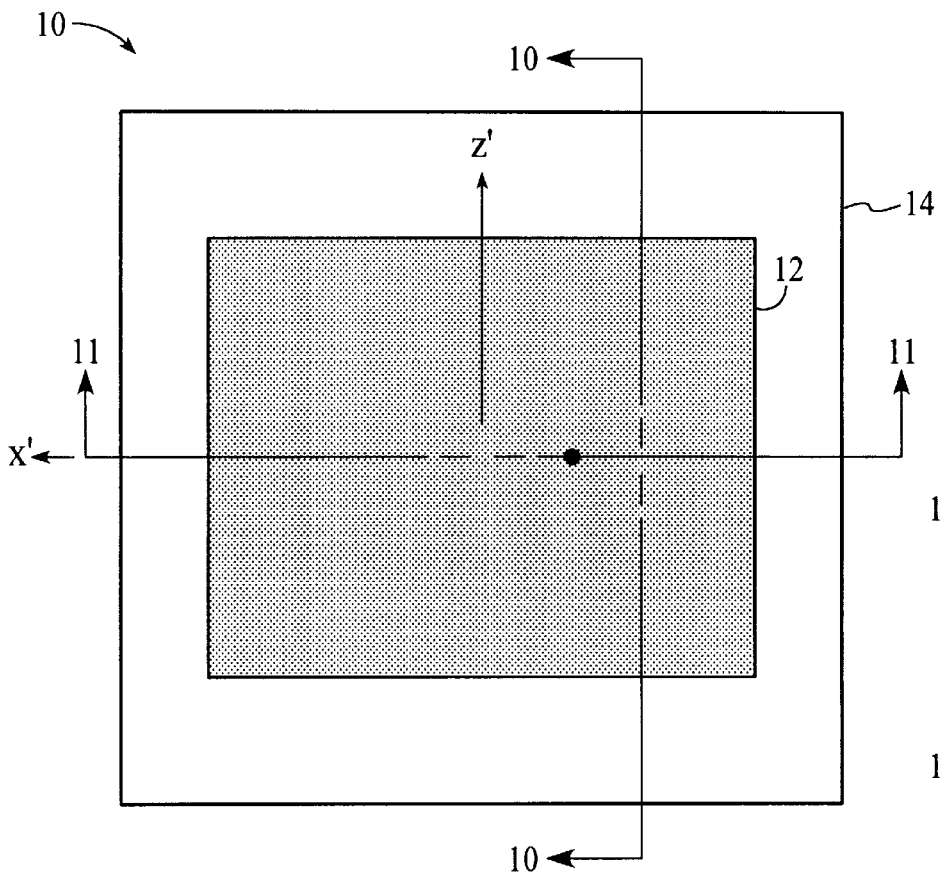
FIG. 9 is a top view of a conventional linearly-polarized patch antenna.
Figure 10:
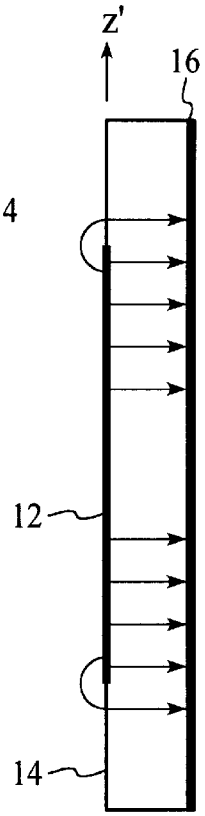
FIGS. 10 and 11 are side views illustrating the dominant mode electric field lines in the antenna illustrated in FIG. 9 taken along sectional lines 10—10 and 11—11, respectively.
Figure 11:
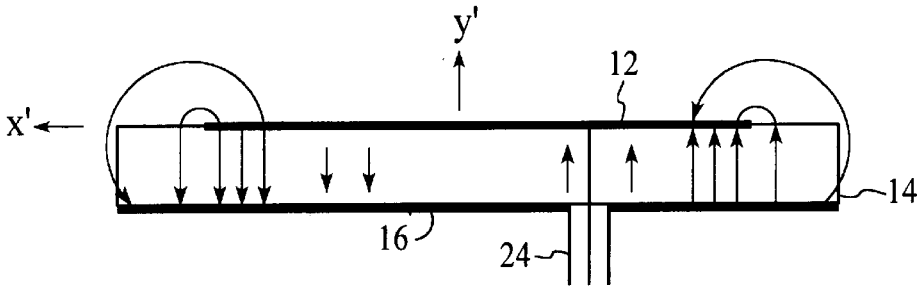

To illustrate the application of the artificial dielectric structure of the present invention to substrates of patch antennas, first consider the conventional linearly-polarized patch antenna 10 illustrated in FIG. 9. FIGS. 10 and 11 are cross-sectional side views of antenna 10 taken along sectional lines 10—10 and 11—11, respectively. As shown, antenna 10 includes a radiating clement being a microstrip patch 12, homogeneous substrate 14, and metalized ground plane 16. FIGS. 10 and 11 illustrate the dominant mode (lowest resonant frequency) electric field lines of patch antenna 10. As illustrated in FIG. 11, patch 12 is resonant in the x' direction with a half sinusoidal variation of vertical electric field (standing wave) under the patch. Surface electric current on the patch is predominantly x'-directed. Note that the electric field lines in substrate 14 are primarily y'-directed (vertical, i.e. perpendicular to the surface of the patch) except at the left and right edges of the patch where a significant x'-directed component is observed due to the fringing fields. The patch is said to radiate from the left and right side edges.

Figure 12:
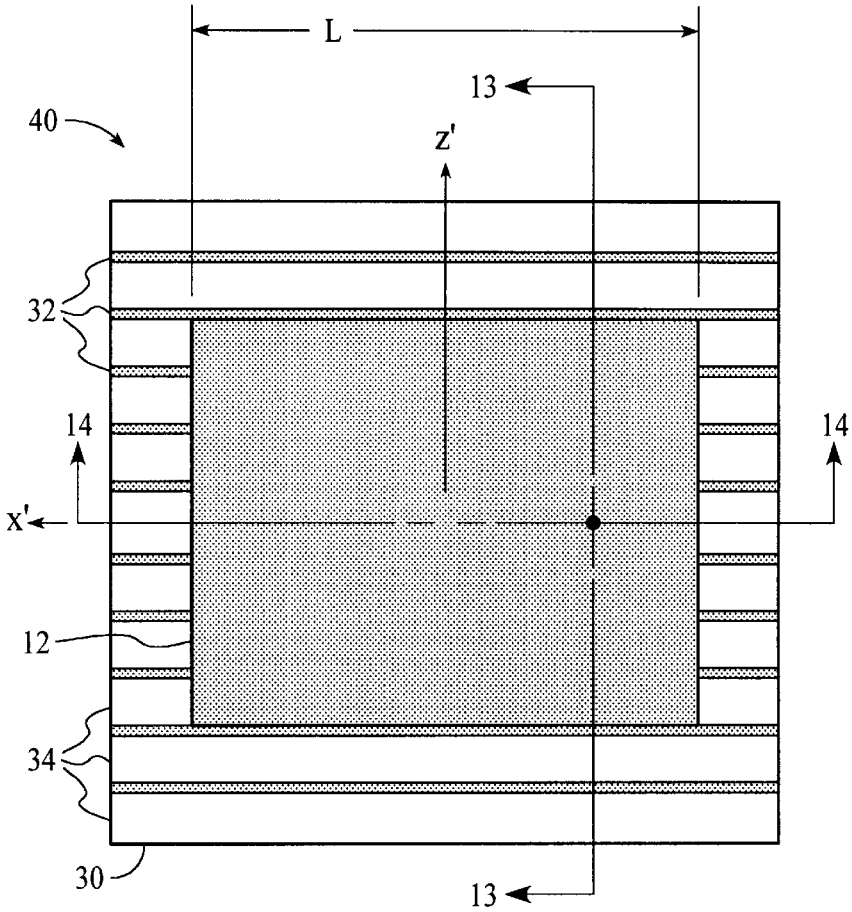
FIG. 12 is a top view of a linearly-polarized patch antenna having an artificial dielectric substrate according to the present invention.
Figure 13:
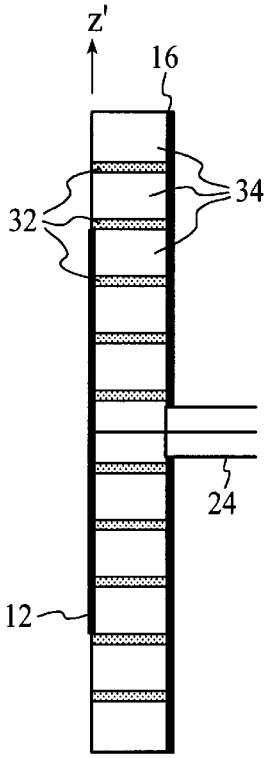
FIGS. 13 and 14 are side views of the antenna illustrated in FIG. 12 taken along sectional lines 13—13 and 14—14, respectively.
Figure 14:
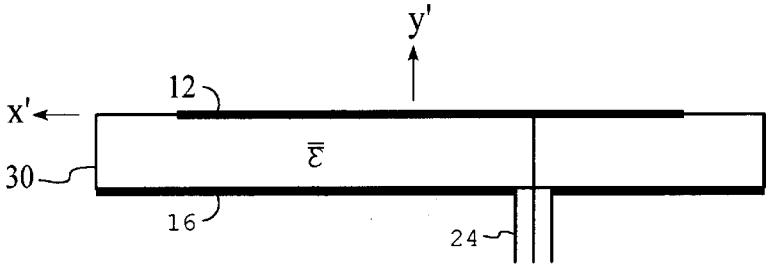

FIGS. 12 through 14 illustrate a linearly-polarized patch antenna 40 according to the invention. FIG. 12 is a top view, and FIGS. 13 and 14 are cross-sectional views taken along lines 13—13 and 14—14, respectively. As shown, antenna 40 is similar in construction to the conventional patch antenna 10 shown in FIGS. 9 through 11 except that the substrate is comprised of artificial dielectric material 30, having alternating layers 32 and 34 of high and low permittivity dielectric materials, respectively. The high permittivity dielectric layer 32 can be, for example, a ceramic material such as PD-85 made by Pacific Ceramics of Sunnyvale, Calif., or it can be, for example, an artificial dielectric material such as a frequency selective surface. The low permittivity dielectric layer 34 can be, for example, a Rohacell foam spacer. A highly conductive surface such as copper tape (not shown) preferably covers the bottom of substrate 30. For cavity-backed patch antennas, this conductive tape will extend up the sides of the substrate.

One way to achieve the same resonant frequency in patch antenna 40, having an artificial dielectric material substrate in accordance with the invention, as in patch antenna 10 with a homogeneous substrate, is to design the artificial dielectric substrate to exhibit the same relative permittivity in the x' and y' directions. Thus, the same amount of electric energy is stored under and around the patch in both cases (i.e., in both artificial dielectric and homogenous dielectric substrates). Accordingly, FIGS. 12 through 14 illustrate the proper orientation of a lightweight artificial dielectric substrate for this case of linear polarization. Note that the uniaxial axis, that is, the axis of anisotropy (where $\epsilon_{x'}=\epsilon_{y'}\neq\epsilon_{z'}$, for example) is perpendicular to the surfaces of the high dielectric layers (the z' axis in FIGS. 12 and 13, i.e. the direction in which the layers are stacked), and is parallel to the surface of the microstrip patch 12.

In accordance with the invention, by orienting direction of stacking the periodic layers which comprise the artificial dielectric substrate as shown in FIGS. 12 through 14, the same high permittivity in the x' and y' directions is achieved such as what would be available if one used an homogeneous substrate. This allows the dominant mode electric fields of the patch antenna (see FIGS. 10 and 11) to be supported since $E_{x'}$ and $E_{y'}$ components dominate the $E_{z'}$ field component. A relatively low dielectric constant in the z' direction ($\epsilon_{rz'}<=\frac{1}{5}\epsilon_{rx'}$, $\frac{1}{5}\epsilon_{ry'}$) for the artificial dielectric substrate will not impact the electric energy stored under the patch, nor the patch resonant frequency, since the modal field of interest has no significant z' directed electric field component. This finesses the problem of maintaining the same amount of stored electric energy ($dW=\frac{1}{2}\epsilon_r\epsilon_0|E|^2$—as found in the homogenous substrate case) by maintaining a high permittivity only in the directions required by the E-field of the dominant patch mode.

It should be noted here that for a more complex antenna, such as a log-periodic slot array, an anisotropic permittivity tensor in which $\epsilon_{x'}\neq\epsilon_{y'}$ may be desired. In other words, the two directions that are not perpendicular to the surfaces of the stacked layers (i.e. the z' direction) may be designed to have dissimilar relative dielectric constants. This concept may be more easily implemented when printed FSS sheets are used as the high permittivity layers.

Antenna 40 can be, for example, a low weight UHF (240–320 MHz) patch antenna. For purposes of comparison, a conventional patch antenna for this application would include, for example, a homogeneous ceramic slab (8"×8"×1.6") of material PD-13 from Pacific Ceramics of Sunnyvale, Calif. where $\epsilon_r=13$ and the specific gravity is 3.45 grams/cm$^3$. The weight of the homogeneous substrate having the required dimensions would thus be about 12.75 lbs.

In the lightweight substrate design of the present invention, layer 32 of artificial dielectric substrate 30 can be, for example, a 0.045" thick ceramic material, such as PD-85from Pacific Ceramics of Sunnyvale, Calif. This material has a relative permittivity of $\epsilon_{r1=85}$, a specific gravity of $sg_1$=3.82 grams/cm$^3$, and a loss tangent of less than 0.0015. To achieve an effective relative permittivity of $\epsilon_{x'}=\epsilon_{y'}=13$, from equation (2), layer 34 can be, for example, 0.250" thick Rohacell foam spacers. The Rohacell foam has properties of $\epsilon_{r2}\approx1.1$ and $sg_2\approx0.1$ grams/cm$^3$. Substrate 30 having these design parameters weighs approximately 2 lbs., 2 oz., which is an 83% weight reduction from the conventional homogeneous substrate.

For fixed-frequency UHF applications as described above, patch 12 of FIG. 12 can be a six inch square patch printed on a 8"×8"×0.060" thick Rogers R04003 printed circuit board (not shown). The circuit board is mounted face down so that patch 12 touches the ceramic slabs of the artificial dielectric substrate 30. The fixed frequency patch antenna 40 built according to these specifications resonates near 274 MHz with a clean single mode resonance. Radiation efficiency, as measured with a Wheeler Cap, is 82.2% (−0.853 dB). Swept gain at boresight, and E-plane and H-plane gain patterns, also compare very similarly to the same patch with a homogeneous substrate. However, as shown above, the fixed frequency patch antenna of the present invention having artificial dielectric substrate 30 weighs about 83% less than the patch antenna having a conventional homogeneous substrate.

The fixed-frequency antenna can be converted into a tunable aperture by replacing the printed superstrate that contains simple microstrip patch 12 with a tunable patch antenna (TPA) superstrate such as that described in U.S. Pat. No. 5,777,581. In addition to corner bolts and a center post (not shown), nylon bolts are preferably used to secure the superstrate at intermediate locations. A tunable patch antenna having an artificial dielectric substrate 30 according to the invention demonstrates tuning states whose frequencies cover 269 to 336 MHz. The radiation efficiency exceeds −2 dB at all states with a bias level of ~43 mA/diode.

In another antenna 40 having a lightweight artificial dielectric substrate design according to the present invention, layer 32 of substrate 30 can be, for example, a 0.020" thick FSS (such as part no. CD-800 of Atlantic Aerospace Electronics Corp., Greenbelt, Md. for example) designed to represent an equivalent capacitance of at least 300 for the x' and y' directions of FIG. 3. This FSS is made from one 0.020" thick layer of FR4 fiberglass whose specific gravity is approximately 2.5 grams/cm$^3$. To achieve an effective relative permittivity of $\epsilon_{x'}=\epsilon_{y'}=13\epsilon_0$, layer 34 can be, for example, a 0.500" thick Rohacell foam of the same type used in the example above. Substrate 30 having these design parameters weighs approximately 6.5 oz., which represents a 97% weight reduction from the conventional homogeneous substrate for this antenna application.

An antenna 40 having a tunable patch antenna (TPA) superstrate as described in U.S. Pat. No. 5,777,581 and having a substrate 30 comprised of the FSS described above tunes from 281.75 to 324.5 MHz, with acceptable return loss and radiation efficiency perfromance. Such an antenna weighs only 2 lb., 10 oz., including an aluminum housing and all the electronic switches (not shown).

Figure 16:
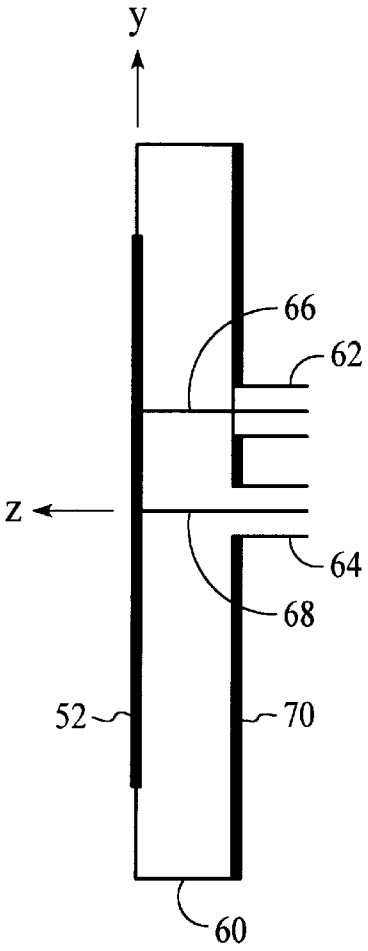
FIG. 16 is a side view of the antenna illustrated in a FIG. 15 taken along sectional line 16—16.
Figure 15:
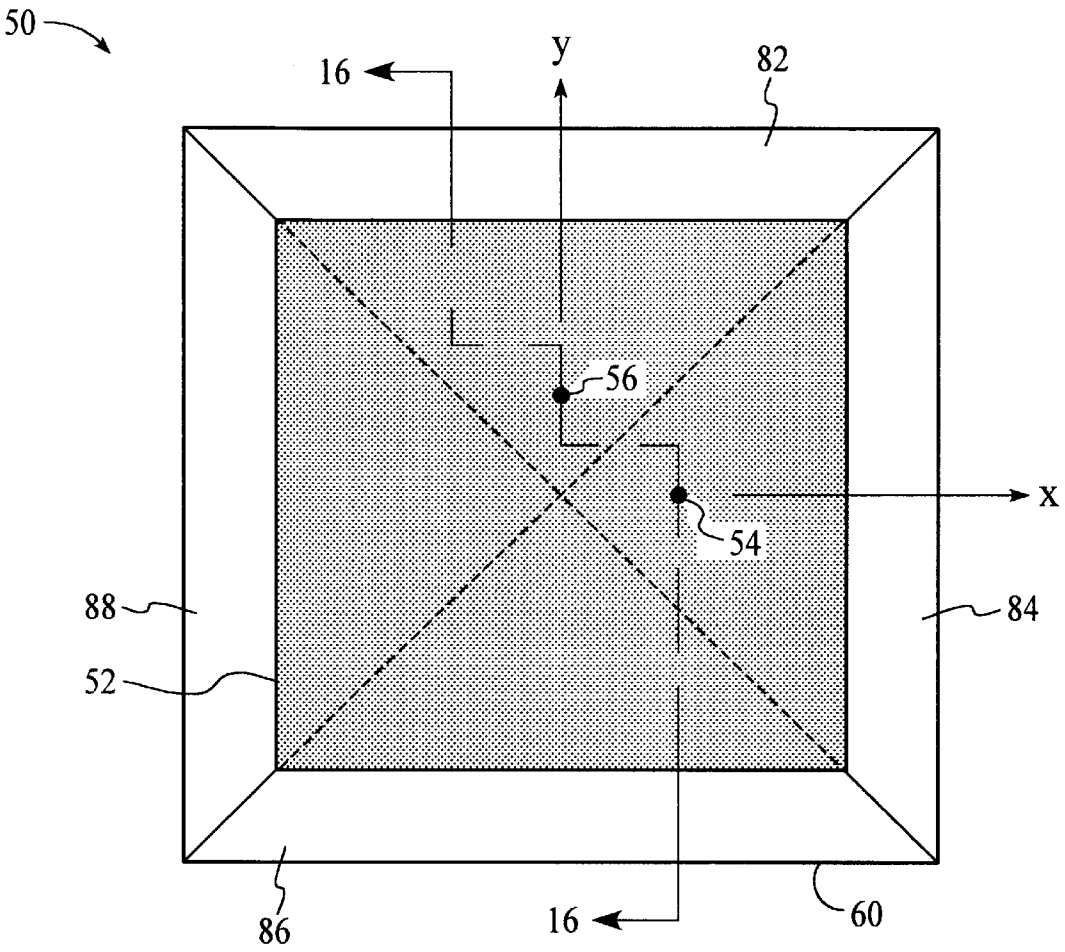
FIG. 15 is a top view of a dual linearly-polarized or circularly-polarized patch antenna having an artificial dielectric substrate according to the present invention.

The use of the periodic artificial dielectric substrate of the present invention can be applied to dual linearly-polarized (or circularly-polarized) patch antennas in addition to linearly-polarized antennas. FIG. 15 shows a dual linearly-polarized patch antenna 50 in accordance with the principles of the invention. FIG. 16 is a side view of antenna 50 taken along sectional line 16—16 in FIG. 15. As shown, antenna 50 has a square patch 52, substrate 60, metalized ground plane 70, and two feeds 54 and 56 positioned on the global x and y axes, respectively, and located an equal distance from the patch center. Coaxial cables 62 and 64 have central conductors 66 and 68 (feed probes) that respectively electrically connect to feeds 54 and 56 so as to couple RF energy to the patch. As shown, substrate 60 has four triangularly-shaped regions 82, 84, 86, and 88 that will be described in more detail below.

In antenna 50, the x and y axis feeds 54 and 56 couple to independent modes whose dominant patch surface currents are x- and y-directed, respectively. For this square patch, the two modes are degenerate since they have the same resonant frequency. In this case all four sides of the patch radiate. Both vertical and radial electric field components are present all along the patch perimeter. As can be seen, feeds 54 and 56 are positioned on portions of the patch that are respectively disposed over adjacent regions 82 and 84 of substrate 60.

Figure 17:
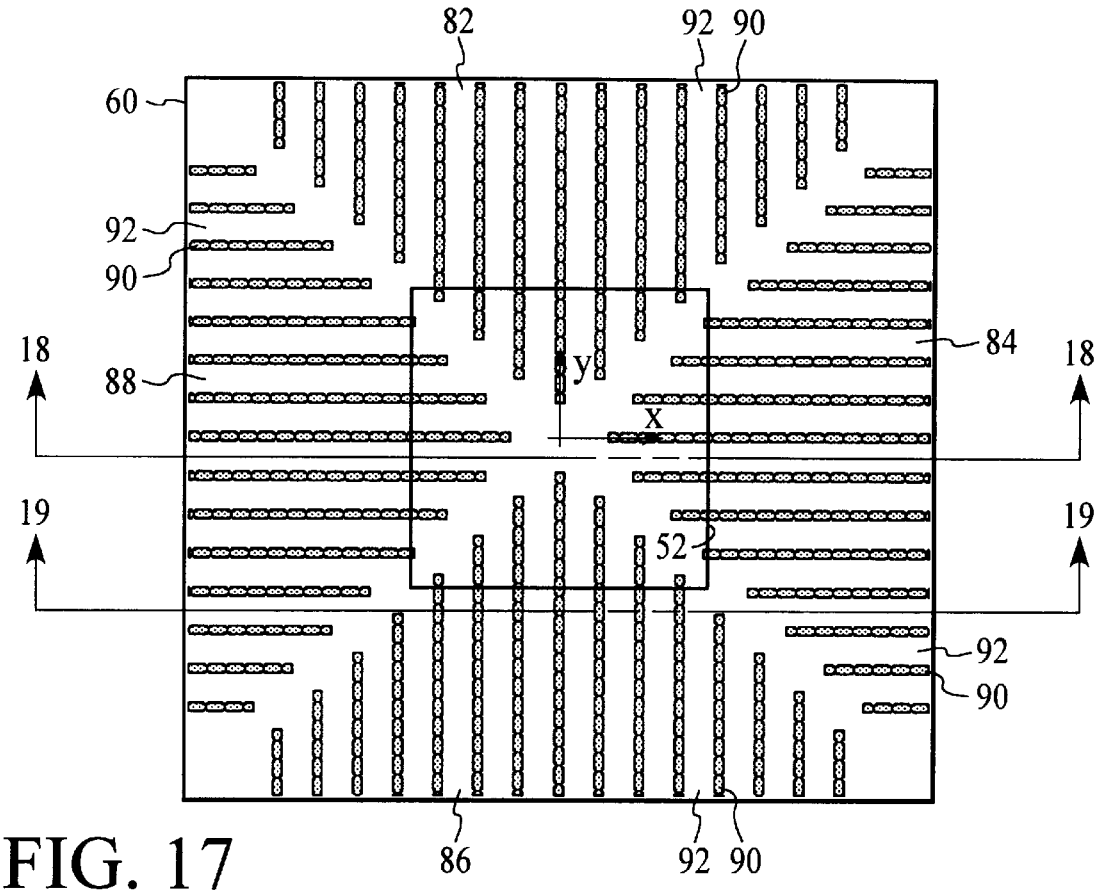
FIG. 17 is a top view illustrating an artificial dielectric substrate that can be used in an antenna such as that illustrated in FIG. 15.
Figure 18:
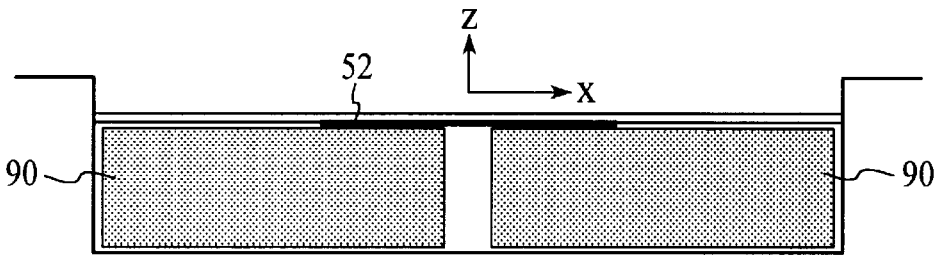
FIGS. 18 and 19 are side views of the artificial dielectric substrate illustrated in FIG. 17 taken along sectional lines 18—18 and 19—19, respectively.
Figure 19:
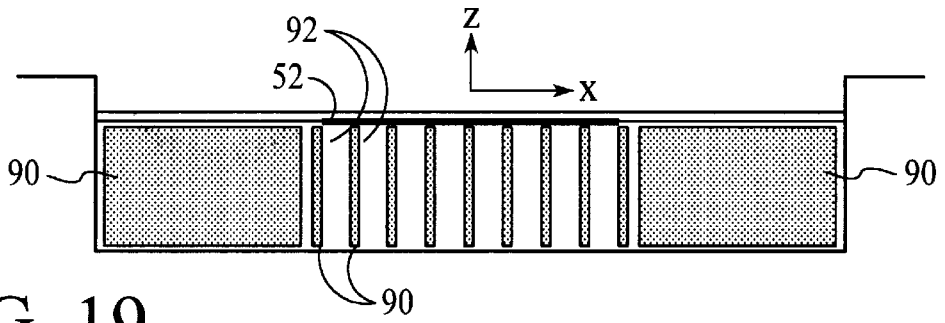

An artificial dielectric substrate 60 that supports dual linear resonant modes is illustrated in FIG. 17. FIGS. 18 and 19 are cross-sectional views of substrate 60 taken along sectional lines 18—18 and 19—19 in FIG. 17, respectively. As can be seen, substrate 60 is composed of four triangular regions 82, 84, 86, and 88. Each region is a separate artificial dielectric structure, having alternating layers of high and low permittivity materials 90 and 92, respectively. The local crystal axes (principal axes) in each artificial dielectric region are $\hat{x}_n$, $\hat{y}_n$, and $\hat{z}_n$ (n=1',2',3',4', where unit vectors $\hat{x}_n$, $\hat{y}_n$, and $\hat{z}_n$ do not necessarily point in the same direction as the global coordinate system (x, y, z)). The uniaxial axis for each region (the local $\hat{z}_n$ axis, assuming $\epsilon_{x'}=\epsilon_{y'}\neq\epsilon_{z'}$, for example) is parallel to the surface of patch 52 and perpendicular to the surfaces of the layers 90 and 92 within each region, such that it is rotated by 90 degrees in the horizontal plane with respect to the uniaxial axis in each adjacent region (see also FIG. 20). This arrangement permits the fringe electric fields at each edge of the patch to be parallel to the stacked layers (the local $\hat{x}_n$–$\hat{y}_n$ planes). As can be further seen, patch 52 and substrate 60 are arranged so that patch 52 overlaps substantially equal portions of regions 82, 84, 86 and 88. The artificial substrate is thus a discrete body of revolution about the global z axis of FIGS. 17–19 which has 4-fold symmetry.

Figure 20:
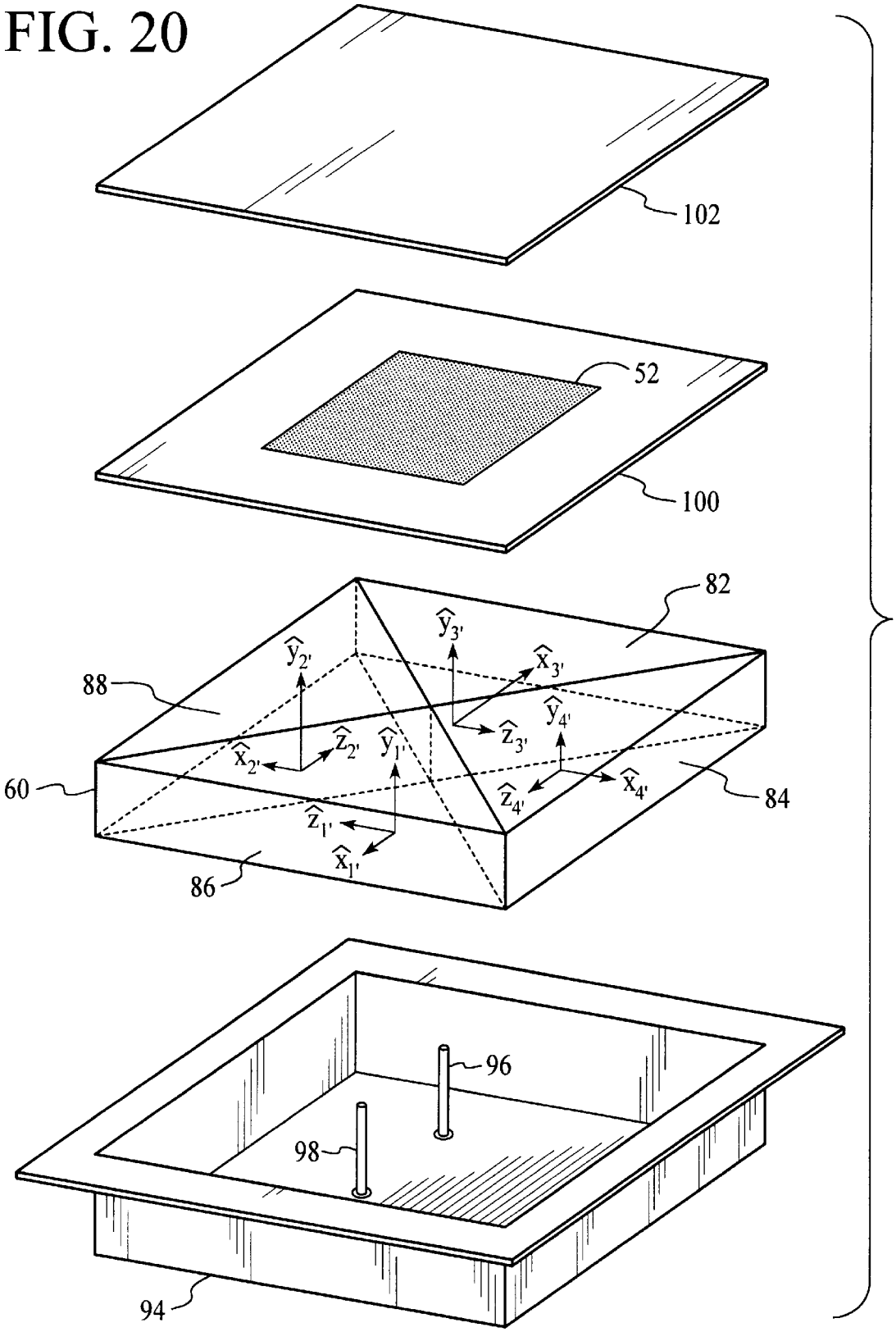
FIG. 20 is an assembly drawing illustrating the configuration of a patch antenna such as that illustrated in FIGS. 17 to 19.

FIG. 20 shows a perspective assembly drawing of a dual linearly-polarized patch antenna 50 constructed with an artificial dielectric substrate such as that illustrated in FIGS. 17 through 19. As can be seen, it includes a 8"×8"×2" aluminum cavity (a conformal housing) 94 in which are provided two feed probes 96 and 98 for connecting RF energy to the respective feeds 54 and 56 on patch 52. Patch 52 is provided on a superstrate 100, which can be, for example, a 8"×8"×0.060" thick Rogers R04003 printed circuit board. Although shown facing away from substrate 60 for illustrative purposes, patch 52 is preferably oriented on the side of superstrate 100 facing substrate 60 so that, when assembled together, patch 52 is in contact with substrate 60. Radome 102 is provided atop the cavity 94 to provide environmental protection for the antenna. This radome may be a simple planar dielectric sheet, such as a 0.060" thick layer of FR4 fiberglass.

In the artificial dielectric substrates illustrated above, a uniform layer thickness has been used throughout the substrate (i.e., uniform period). However, the layer thicknesses need not be uniform, and substrates having uniform layer thicknesses may not be desirable in, for example, microstrip patch antennas designed to resonate with higher order modes.

Figure 22:
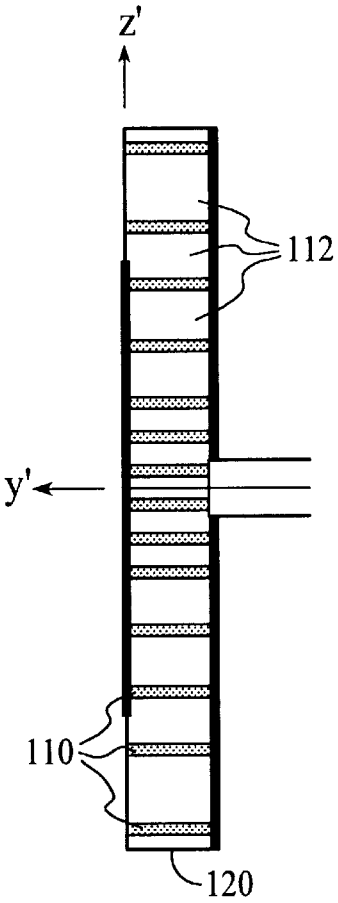
FIG. 22 is a side view of the antenna illustrated in FIG. 21 taken along sectional line 22—22.
Figure 21:
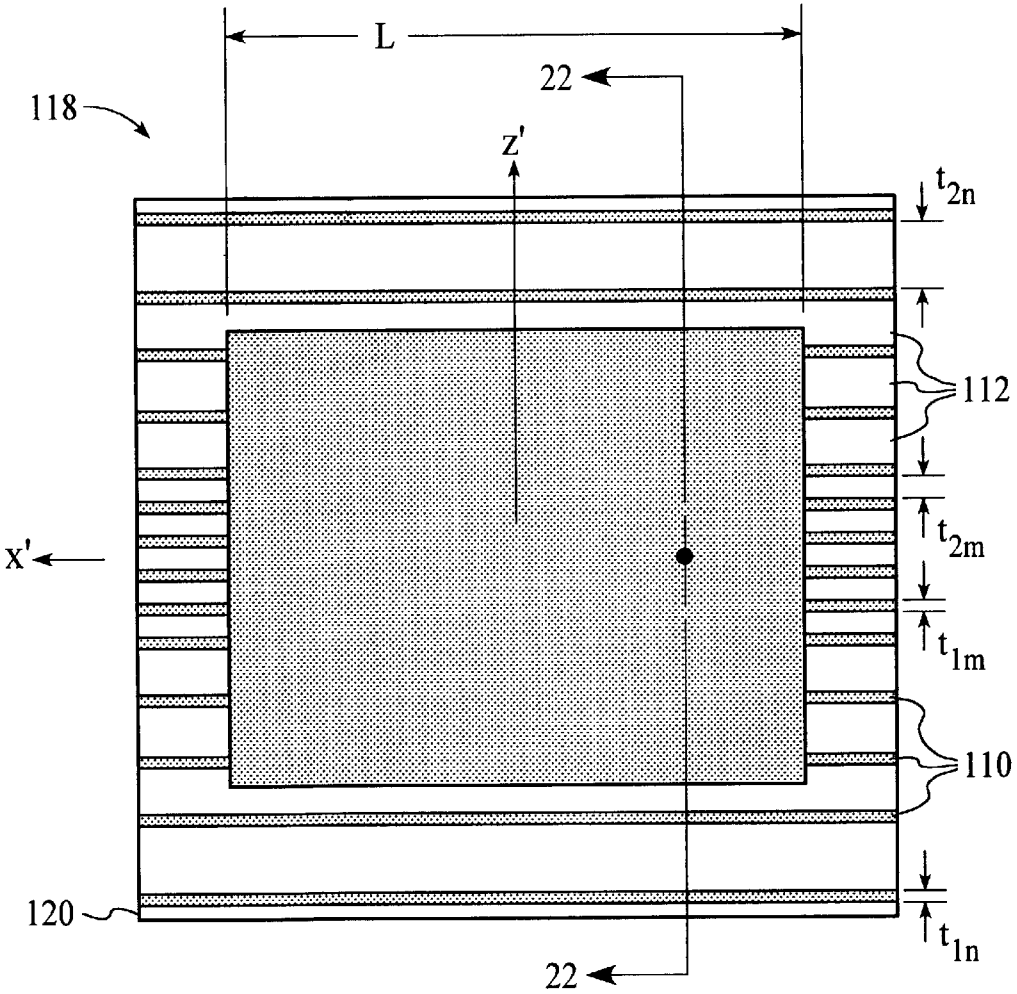
FIG. 21 is a top view of a patch antenna having a non-uniform artificial dielectric substrate in accordance with an aspect of the invention.

FIG. 21 illustrates a linearly-polarized patch antenna 118 having a nonuniform artificial dielectric substrate 120. FIG. 22 is a cross-sectional view of antenna 118 taken along sectional line 22—22 in FIG. 21. Both the high and low permittivity dielectric layers, 110 and 112, respectively, may have a variable thickness in the z' direction. That is, as illustrated, layers 110 may have thickness $t_{1m}$ near the center of the substrate, and thickness $t_{1n}$ near the periphery of the substrate in the z' direction, where $t_{1m} \neq t_{1n}$. Likewise, layers 112 may have thickness $t_{2m}$ near the center of the substrate, and thickness $t_{2n}$ near the periphery of the substrate in the z'-direction, where $t_{2m} \neq t_{2n}$.

Figure 24:
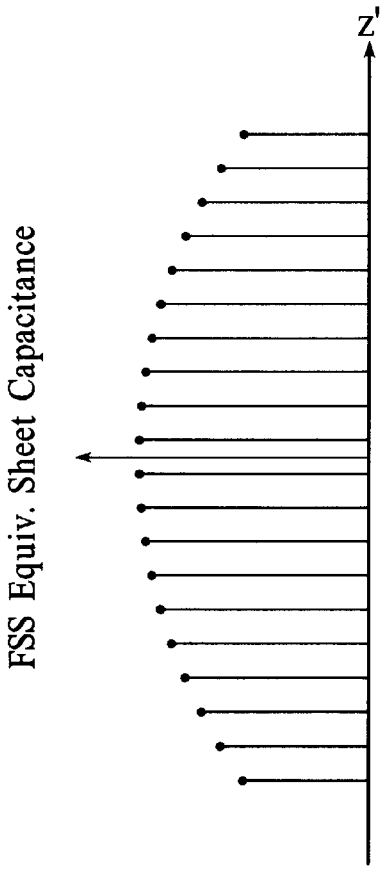
FIG. 24 is a graph illustrating the non-uniform equivalent sheet capacitance of FSS layers in the artificial dielectric substrate illustrated in FIG. 23.
Figure 23:
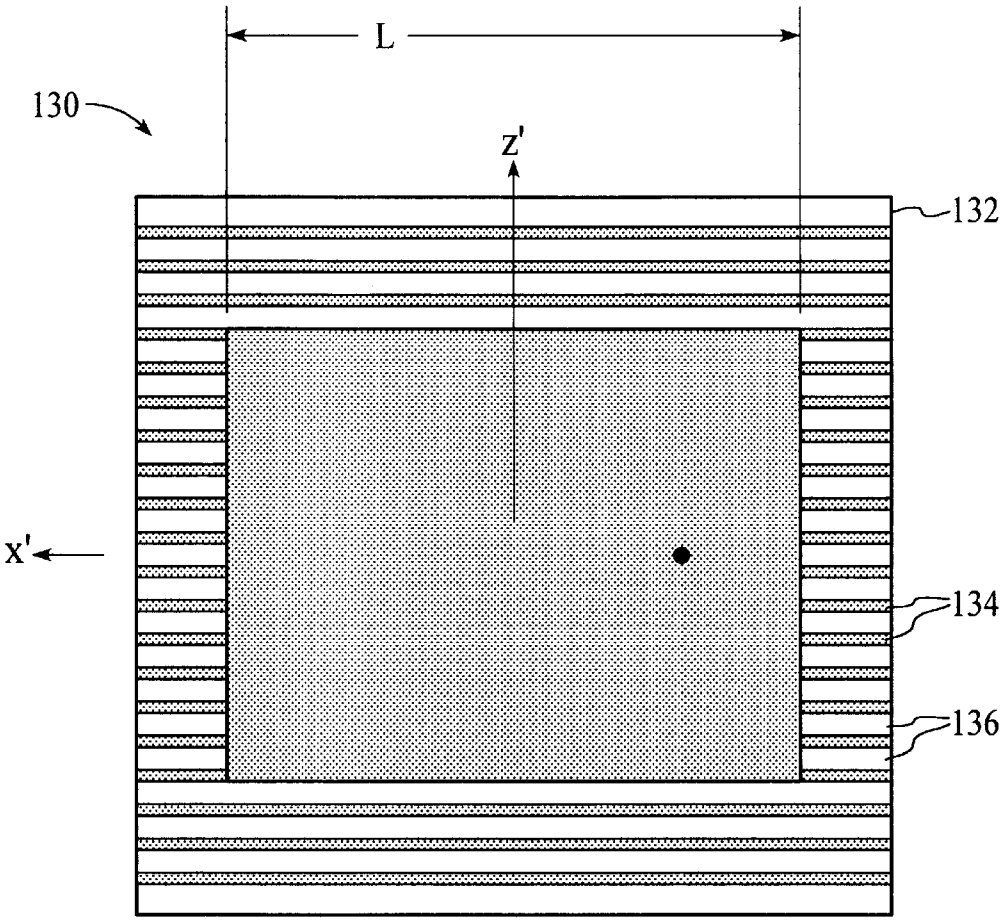
FIG. 23 is a top view of a patch antenna having a non-uniform artificial dielectric substrate in accordance with another aspect of the invention.

Another degree of freedom, by virtue of the FSS dielectric layer concept according to the invention, is to employ capacitive FSS layers of non-uniform equivalent sheet capacitance in a regular period to achieve a non-uniform distribution of effective dielectric constant. FIG. 23 illustrates a linearly-polarized patch antenna 130 having a non-uniform artificial dielectric substrate 132. The layers in substrate 132 are comprised of alternating high permittivity FSS materials 134 and low permittivity dielectric materials 136. FIG. 24 is a histogram that further illustrates the non-uniform equivalent sheet capacitance of corresponding layers 134 in substrate 132. As can be seen, layers 134 near the center of the substrate in the z' direction have a higher equivalent sheet capacitance than layers 134 near the periphery of the substrate. Depending on the electric field distribution of the desired patch antenna resonant mode, it may be preferred to vary the non-uniform equivalent sheet capacitance such that it is higher near the perimeter of the patch or periphery of the substrate, and lower near the center.

Figure 25:
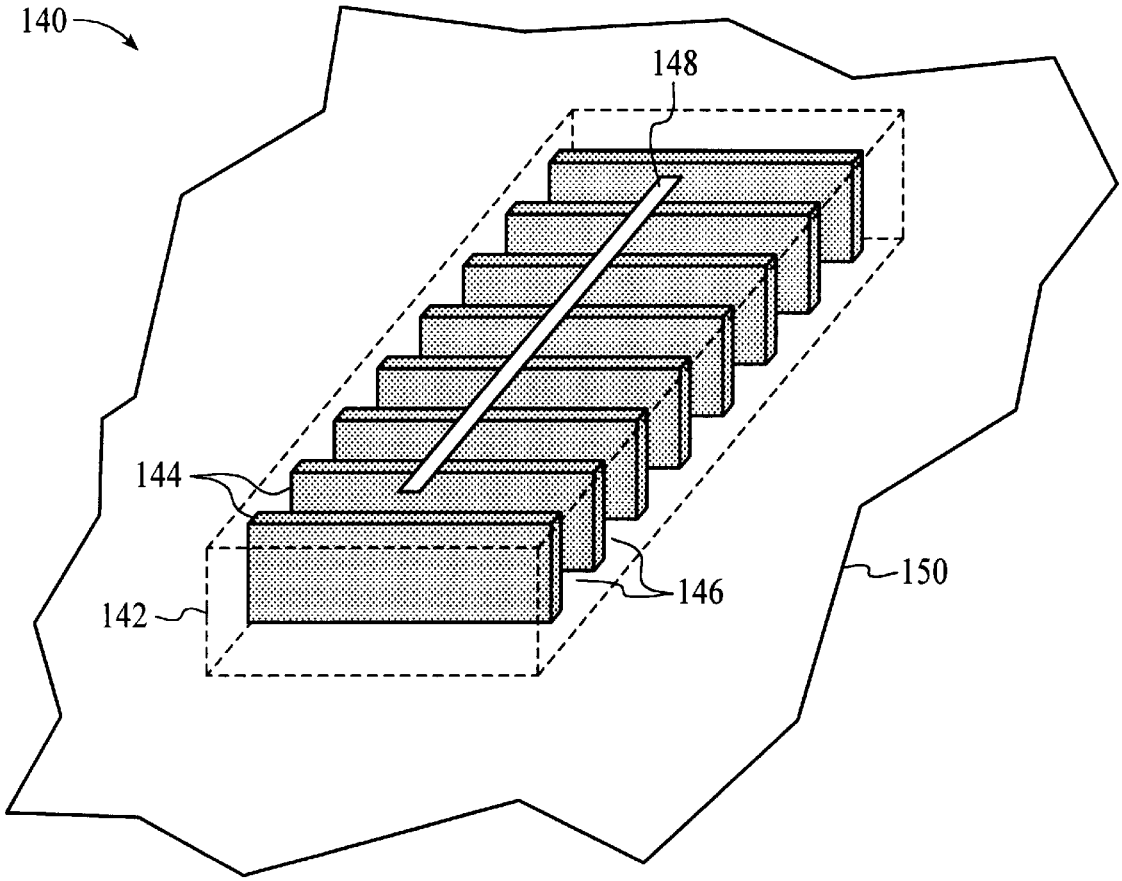
FIG. 25 is a perspective view of a radiating slot antenna having an artificial dielectric substrate in accordance with the principles of the invention.

The principles of the invention can be applied to other cavity-backed antennas in addition to the microstrip patch antennas described hereinabove. For example, FIG. 25 illustrates a slot antenna 140 in which cavity 142 houses an artificial dielectric substrate comprised of alternating high permittivity layers 144 and low permittivity layers 146. Disposed between the substrate and ground plane 150 is a rectangular radiating slot 148. The high permittivity layers 144 can be, for example, FSS layers, and the high permittivity layers 146 can be, for example, foam spacers.

Figure 26:
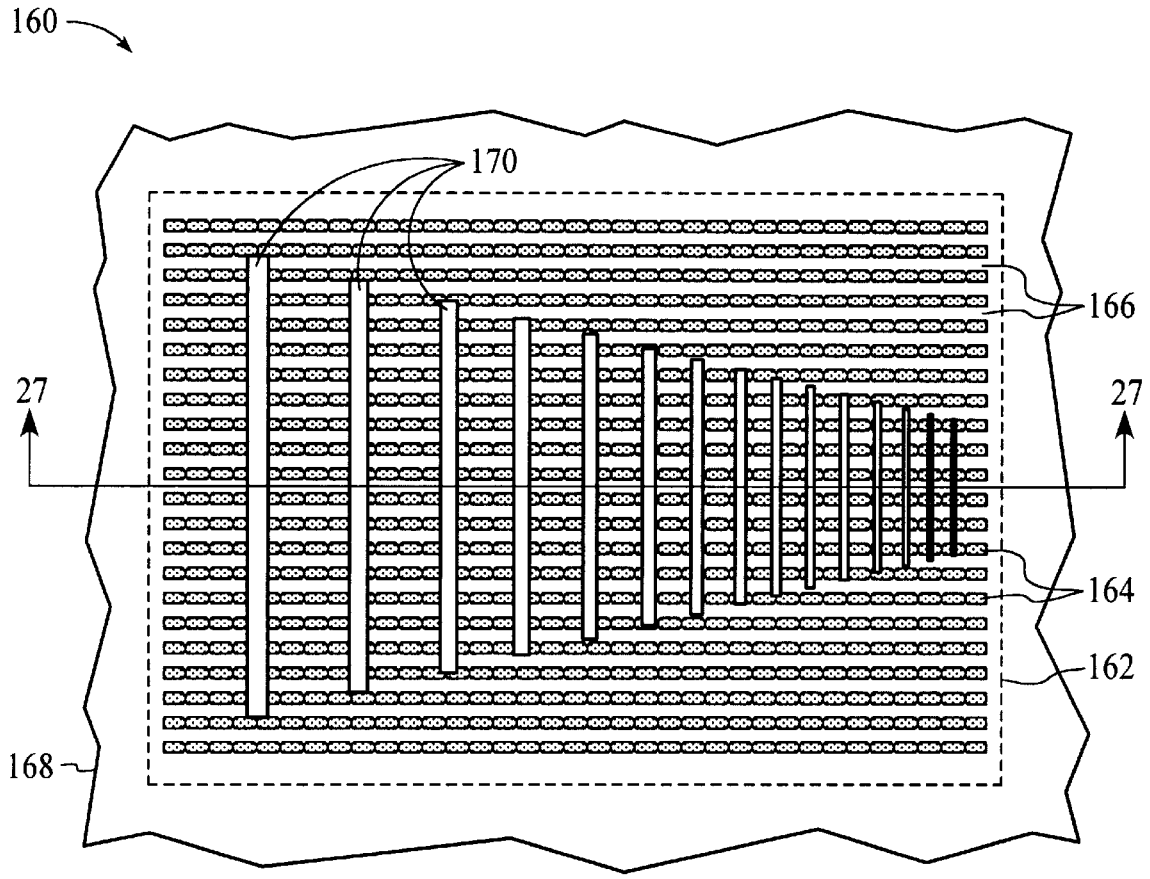
FIG. 26 is a top view of a log-periodic slot array having an artificial dielectric substrate in accordance with the principles of the invention.
Figure 27:
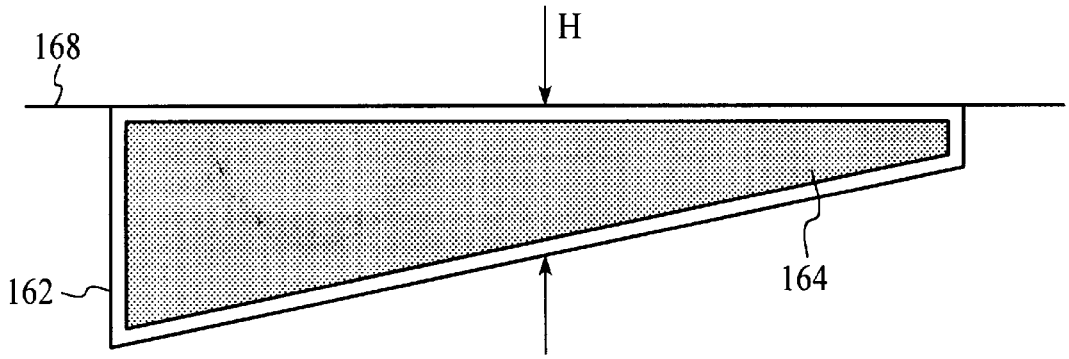
FIG. 27 is a side view of the antenna illustrated in FIG. 26 taken along sectional line 27—27.

FIG. 26 illustrates another example of the invention applied to a log-periodic slot array antenna 160 in which cavity 162 houses an artificial dielectric substrate comprised of alternating high permittivity layers 164 and low permittivity layers 166. Disposed between the substrate and ground plane 168 is a log periodic array of rectangular radiating slots 170. The high permittivity layers 164 can be, for example, FSS layers, and the high permittivity layers 166 can be, for example, foam spacers. FIG. 27 is a cross-sectional view of FIG. 26 taken along line 27—27 in FIG. 26, and it shows how the height H of the artificial dielectric substrate having high permittivity layer 164 decreases in relation to the decreasing length, width and spacing of rectangular radiating slots 170.

Figure 28:
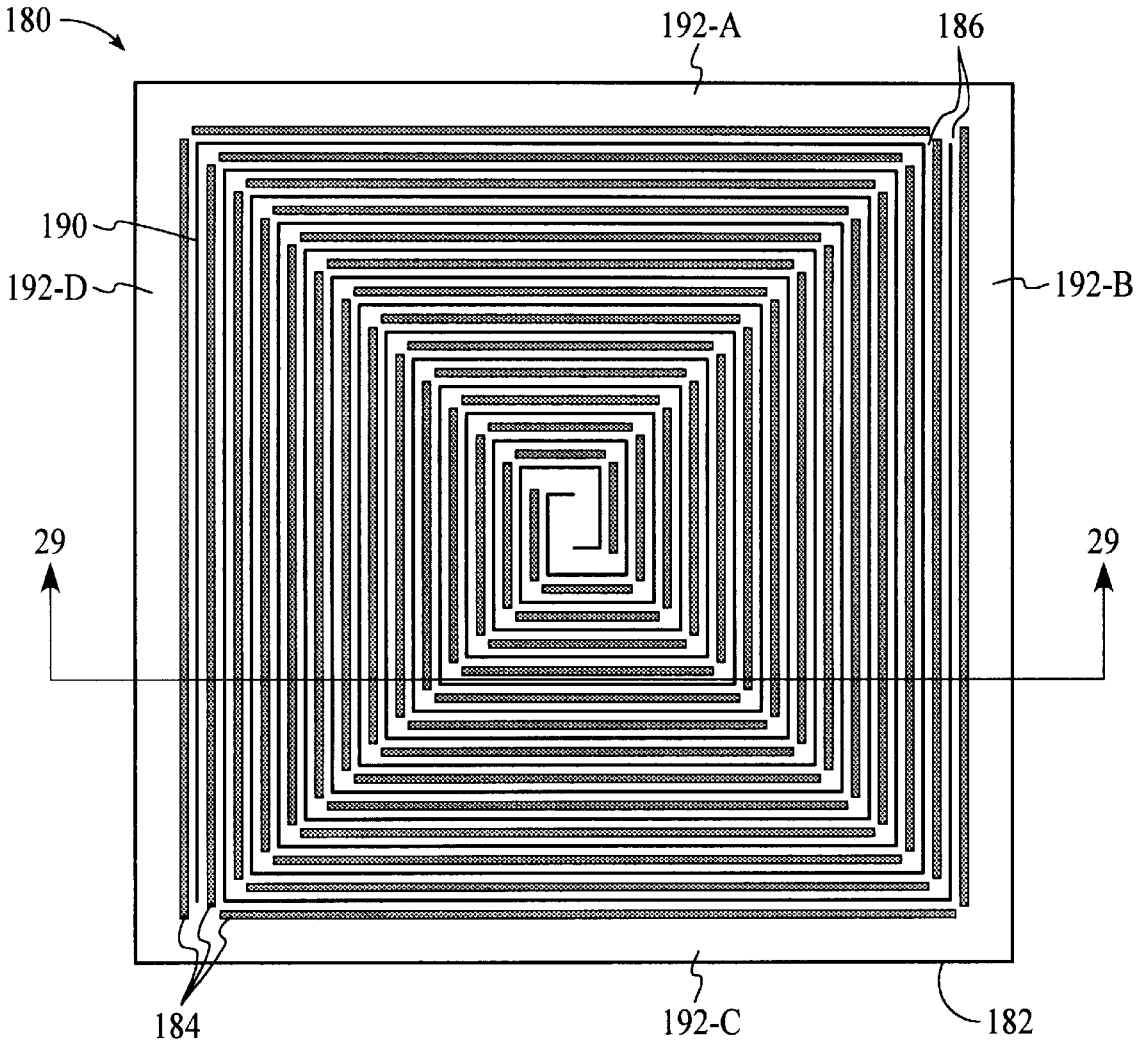
FIG. 28 is a top view of a cavity-backed Archimedian spiral antenna having an artificial dielectric substrate in accordance with the principles of the invention.
Figure 29:
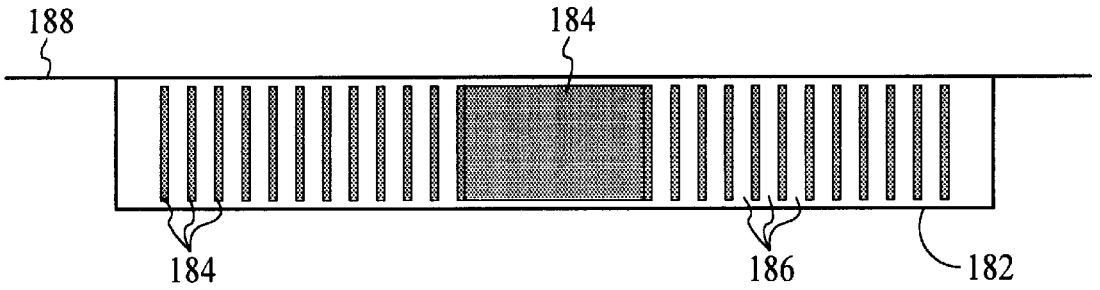
FIG. 29 is a side view of the antenna illustrated in FIG. 28 taken along sectional line 29—29.

FIG. 28 illustrates yet another example of the invention applied to a cavity-backed Archimedian spiral antenna 180 in which cavity 182 houses an artificial dielectric substrate comprised of four regions 192-A, 192-B, 192-C and 192-D of alternating high permittivity layers 184 and low permittivity layers 186, similar to the artificial dielectric substrate described with relation to FIG. 17. Disposed between the substrate and ground plane 188 is a radiating Archimedian spiral element 190. The high permittivity layers 184 can be, for example, FSS layers, and the high permittivity layers 186 can be, for example, foam spacers. FIG. 29 is a cross-sectional view of FIG. 28 taken along line 29—29 in FIG. 28.

Although the present invention has been described in detail with reference to the preferred embodiments thereof, those skilled in the art will appreciate that various substitutions and modifications can be made thereto without departing from the inventive concepts set forth herein. Accordingly, the present invention is not limited to the specific examples described; rather, these and other variations can be made while remaining within the spirit and scope of the invention as defined in the appended claims.

What is claimed is:

1. An artificial dielectric structure comprising:

first and second stacked dielectric layers having first and second permittivities, respectively, said first permittivity being different from said second permittivity, wherein said artificial dielectric structure has a permittivity tensor comprised of permittivity components respectively defined along three principal axes, one of said permittivity components along a certain axis of said principal axes being substantially different than both of the other two of said permittivity components, and wherein said dielectric layers each have substantially parallel top and bottom surfaces and are stacked in a first direction perpendicular to said top and bottom surfaces such that said top surface of said first dielectric layer is adjacent to said bottom surface of said second dielectric layer, said certain axis being parallel to said first direction, and wherein said other two of said permittivity components are greater than said one permittivity component along said certain axis by at least a factor of 5, and wherein said first and second dielectric layers have first and second thicknesses $t_1$ and $t_2$, and first and second permittivities $\epsilon_{r1}$ and $\epsilon_{r2}$ respectively, said first and second thicknesses satisfying the condition that $t_n << 1/\beta_n$, where $\beta_n = \omega \times \mathrm{sqrt}(\mu_0 \epsilon_0 \epsilon_m)$ for n=1,2, and $\omega=2\pi f$ where f is the maximum operating frequency of said artificial dielectric structure.

2. An artificial dielectric structure as defined in claim 1, wherein said other two of said permittivity components are substantially equal.

3. An artificial dielectric structure as defined in claim 1, wherein one of said first and second dielectric layers is comprised of an artificial dielectric material.

4. An artificial dielectric structure as defined in claim 3, wherein said one dielectric layer is comprised of a capacitive frequency selective surface.

5. An artificial dielectric structure as defined in claim 1, further comprising third and fourth stacked dielectric layers having third and fourth permittivities, respectively, said third permittivity being different from said fourth permittivity.

6. An artificial dielectric structure as defined in claim 5, wherein said third and fourth permittivities are the same as said first and second permittivities, respectively, of said first and second dielectric layers.

7. An artificial dielectric structure as defined in claim 6, wherein said first and second dielectric layers have first and second thicknesses, respectively, and said third and fourth dielectric layers have third and fourth thicknesses, respectively, said third thickness being the same as said first thickness, said fourth thickness being the same as said second thickness.

8. An artificial dielectric structure as defined in claim 6, wherein said first and second dielectric layers have first and second thicknesses, respectively, and said third and fourth dielectric layers have third and fourth thicknesses, respectively, said third thickness being different from said first thickness, said fourth thickness being different from said second thickness.

9. An artificial dielectric structure as defined in claim 5, wherein said third permittivity is the same as said first permittivity of said first dielectric layer and said fourth permittivity is different than said second permittivity of said second dielectric layer.

10. An artificial dielectric structure as defined in claim 9, wherein said first and second dielectric layers have first and second thicknesses, respectively, and said third and fourth dielectric layers have third and fourth thicknesses, respectively, said third thickness being the same as said first thickness, said fourth thickness being the same as said second thickness.

11. An artificial dielectric structure as defined in claim 9, wherein said second and fourth dielectric layers are comprised of an artificial dielectric material.

12. An artificial dielectric structure as defined in claim 11, wherein said second and fourth dielectric layers are comprised of an artificial dielectric material is a frequency selective surface.

13. An antenna comprising:

a radiating element that is adapted to receive RF energy;

a metalized ground plane; and a substrate disposed between said radiating element and said metalized ground plane, said substrate comprising at least first and second stacked dielectric layers having first and second permittivities, respectively, said first permittivity being different from said second permittivity, said substrate having a permittivity tensor comprised of permittivity components respectively defined along three principal axes, one of said permittivity components along a certain axis of said principal axes being substantially different than both of the other two of said permittivity components, wherein said dielectric layers each have substantially parallel top and bottom surfaces and are stacked in a first direction perpendicular to said top and bottom surfaces such that said top surface of said first dielectric layer is adjacent to said bottom surface of said second dielectric layer, said certain axis being parallel to said first direction, and wherein said other two of said permittivity components are greater than said one permittivity component along said certain axis by at least a factor of 5, and wherein said first and second dielectric layers have first and second thicknesses $t_1$ and $t_2$, and first and second permittivities $\epsilon_{r1}$ and $\epsilon_{r2}$ respectively, said first and second thicknesses satisfying the condition that $t_n<<1/\beta_n$, where $\beta_n=\omega\times\mathrm{sqrt}(\mu_0\epsilon_0\epsilon_{rn})$ for n=1,2, and $\omega=2\pi f$ where f is the maximum operating frequency of said antenna.

14. An antenna as defined in claim 13, further comprising:

a first feed probe that is adapted to couple RF energy to said radiating element.

15. An antenna as defined in claim 14, further comprising:

a second feed probe that is adapted to couple RF energy to said radiating element, said first and second feed probes being adapted to couple to independent principal modes of surface currents in said radiating element.

16. An antenna as defined in claim 13, wherein said other two of said permittivity components are substantially equal.

17. An antenna as defined in claim 13, wherein one of said first and second dielectric layers is comprised of an artificial dielectric material.

18. An antenna as defined in claim 17, wherein said one dielectric layer is comprised of a capacitive frequency selective surface.

19. An antenna comprising:

a radiating element that is adapted to receive RF energy;

a metalized ground plane; and a substrate disposed between said radiating element and said metalized ground plane, said substrate comprising at least first and second stacked dielectric layers having first and second permittivities, respectively, said first permittivity being different from said second permittivity, said substrate having a permittivity tensor comprised of permittivity components respectively defined along three principal axes, one of said permittivity components along a certain axis of said principal axes being substantially different than both of the other two of said permittivity components, wherein said dielectric layers each have substantially parallel top and bottom surfaces and are stacked in a first direction perpendicular to said top and bottom surfaces such that said top surface of said first dielectric layer is adjacent to said bottom surface of said second dielectric layer, said certain axis being parallel to said first direction, wherein said radiating element has a surface, said surface being parallel to said first direction.

20. An antenna as defined in claim 13, wherein said radiating element is comprised of a microstrip patch.

21. An antenna as defined in claim 13, wherein said radiating element is comprised of a radiating slot.

22. An antenna as defined in claim 13, wherein said radiating element is comprised of an Archimedian spiral, said radiating element being disposed substantially in contact with both said first and second dielectric layers of said substrate.

23. An antenna as defined in claim 13, further comprising a cavity that houses said substrate.

24. An antenna as defined in claim 23, wherein said radiating element is comprised of a microstrip patch.

25. An antenna as defined in claim 23, wherein said radiating element is comprised of a radiating slot.

26. An antenna as defined in claim 23, wherein said radiating element is comprised of an Archimedian spiral, said radiating element being disposed substantially in contact with both said first and second dielectric layers of said substrate.

27. A patch antenna, comprising:

a microstrip patch that is adapted to receive RF energy;

a metalized ground plane; and a substrate disposed between said microstrip patch and said metalized ground plane, said substrate comprising four artificial dielectric structures, said artificial dielectric structures being arranged so that each artificial dielectric structure is adjacent to two other of said artificial dielectric structures, each artificial dielectric structure having at least first and second stacked dielectric layers having first and second permittivities, respectively, said first permittivity being different from said second permittivity, said each artificial dielectric structure having a permittivity tensor comprised of permittivity components respectively defined along three principal axes, one of said permittivity components along a certain axis of said principal axes being substantially different than both of the other two of said permittivity components, wherein said certain axis of said each artificial dielectric structure is orthogonal to said certain axis of each of said two adjacent artificial dielectric structures, wherein said radiating element is disposed substantially in contact with both said first and second dielectric layers of said each artificial dielectric structure.

28. A patch antenna as defined in claim 27, further comprising:

a first feed probe that is adapted to couple RF energy to said microstrip patch; and a second feed probe that is adapted to couple RF energy to said microstrip patch, said first and second feed probes being adapted to couple to independent principal modes of surface currents in said microstrip patch.

29. A patch antenna as defined in claim 28, wherein said first feed probe couples to a portion of said microstrip patch that is disposed over a first one of said four artificial dielectric structures, and said second feed probe couples to a portion of said microstrip patch that is disposed over a second one of said four artificial dielectric structures, said first artificial dielectric structure being arranged adjacent to said second artificial dielectric structure.

30. A patch antenna as defined in claim 27, wherein said dielectric layers of said each artificial dielectric structure each have substantially parallel top and bottom surfaces and are stacked in a first direction perpendicular to said top and bottom surfaces such that said top surface of said first dielectric layer is adjacent to said bottom surface of said second dielectric layer, said certain axis of said each artificial dielectric structure being parallel to said first direction.

31. An antenna as defined in claim 27, wherein said other two of said permittivity components are substantially equal.

32. An artificial dielectric structure as defined in claim 27, wherein said other two of said permittivity components are greater than said one permittivity component along said certain axis by at least a factor of 5.

33. An artificial dielectric structure as defined in claim 31, wherein said other two of said permittivity components are greater than said one permittivity component along said certain axis by at least a factor of 5.

34. A patch antenna as defined in claim 27, wherein one of said first and second dielectric layers of said each artificial dielectric structure is comprised of an artificial dielectric material.

35. A patch antenna as defined in claim 34, wherein said one dielectric layer is comprised of a capacitive frequency selective surface.

36. A patch antenna as defined in claim 27, wherein said first and second dielectric layers of said each artificial dielectric structure have first and second thicknesses $t_1$ and $t_2$, and first and second permittivities $\epsilon_{r1}$ and $\epsilon_{r2}$ respectively, said first and second thicknesses satisfying the condition that $t_n << 1/\beta_n$, where $\beta_n = \omega \times \mathrm{sqrt}(\mu_0 \epsilon_0 \epsilon_m)$ for n=1,2, and $\omega = 2\pi f$ where f is the maximum operating frequency of said patch antenna.

37. A patch antenna as defined in claim 27, wherein said patch is arranged so that it is disposed over substantially equal portions of said four artificial dielectric structures.

38. A patch antenna, comprising:

a microstrip patch that is adapted to receive RF energy;

a metalized ground plane; and a substrate disposed between said microstrip patch and said metalized ground plane, said substrate comprising four artificial dielectric structures, said artificial dielectric structures being arranged so that each artificial dielectric structure is adjacent to two other of said artificial dielectric structures, each artificial dielectric structure having at least first and second stacked dielectric layers having first and second permittivities, respectively, said first permittivity being different from said second permittivity, said each artificial dielectric structure having a permittivity tensor comprised of permittivity components respectively defined along three principal axes, one of said permittivity components along a certain axis of said principal axes being substantially different than both of the other two of said permittivity components, wherein said certain axis of said each artificial dielectric structure is orthogonal to said certain axis of each of said two adjacent artificial dielectric structures, wherein said dielectric layers of said each artificial dielectric structure each have substantially parallel top and bottom surfaces and are stacked in a first direction perpendicular to said top and bottom surfaces such that said top surface of said first dielectric layer is adjacent to said bottom surface of said second dielectric layer, said certain axis of said each artificial dielectric structure being parallel to said first direction, and wherein said patch has a surface, said surface being parallel to said first direction of said four artificial dielectric structures.

39. A method of providing an antenna substrate with a desired permittivity $\epsilon_d$, wherein said antenna substrate is adapted for use in a microstrip patch antenna having a patch with a patch surface, said method comprising:

identifying a first dielectric material having a first permittivity $\epsilon_{r1}$;

identifying a second dielectric material having a second permittivity $\epsilon_{r2}$, said first and second dielectric materials each having substantially parallel top and bottom surfaces;

adjusting respective first and second thicknesses $t_1$ and $t_2$ between said top and bottom surfaces of said first and second dielectric materials in accordance with said desired permittivity;

stacking said first and second dielectric materials in a first direction perpendicular to said top and bottom surfaces such that said top surface of said first dielectric material is adjacent to said bottom surface of said second dielectric material; and orienting said stacked first and second dielectric materials so that said first direction is parallel to said patch surface.

40. A method as defined in claim 39, wherein said antenna substrate is adapted for use in an antenna having a maximum operating frequency f ($\omega=2\pi f$), said method further comprising:

maintaining the condition that $t_n<<1/\beta_n$, where $\beta_n=\omega\times\text{sqrt}(\mu_0\epsilon_0\epsilon_{rn})$ for n=1,2.

41. A method as defined in claim 40, wherein said adjusting step includes:

selecting a pair of thicknesses $t_1$ and $t_2$ that satisfy a relationship between said desired permittivity, said first and second thicknesses and said first and second permittivities, said relationship being:

$$\varepsilon_d = \frac{\varepsilon_{r1}t_1 + \varepsilon_{r2}t_2}{t_1 + t_2}.$$

42. A method as defined in claim 39, wherein said antenna substrate has a desired weight, said first and second dielectric layers having first and second specific gravities, respectively, said adjusting step being performed in further accordance with said desired weight.

43. A method of reducing the weight of an antenna having a substrate with a desired permittivity and an undesired specific gravity, wherein said antenna substrate is adapted for use in a microstrip patch antenna having a patch with a patch surface, comprising:

identifying a first dielectric material having a first permittivity $\epsilon_{r1}$ and a first specific gravity;

identifying a second dielectric material having a second permittivity $\epsilon_{r2}$ and a second specific gravity, at least one of said first and second specific gravities being less than said undesired specific gravity, said dielectric materials each having substantially parallel top and bottom surfaces;

adjusting respective first and second thicknesses $t_1$ and $t_2$ between said top and bottom surfaces of said first and second dielectric materials in accordance with said desired permittivity and a desired specific gravity less than said undesired specific gravity;

stacking said first and second dielectric materials in a first direction perpendicular to said top and bottom surfaces such that said top surface of said first dielectric material is adjacent to said bottom surface of said second dielectric material to form an artificial dielectric structure;

replacing said substrate with said artificial dielectric structure; and orienting said stacked first and second dielectric materials so that said first direction is parallel to said patch surface.

* * * * *